US005336466A

United States Patent [19]

Iba et al.

[11] Patent Number: 5,336,466

[45] Date of Patent: Aug. 9, 1994

[54] HEAT RESISTANT MAGNESIUM ALLOY

[75] Inventors: Hideki Iba; Chikatoshi Maeda, both of Toyota, Japan

[73] Assignee: Toyota Jidosha Kabushiki Kaisha, Japan

[21] Appl. No.: 918,602

[22] Filed: Jul. 24, 1992

[30] Foreign Application Priority Data

Jul. 26, 1991 [JP] Japan ..... 3-210305
Dec. 20, 1991 [JP] Japan ..... 3-355893

[51] Int. Cl.[5] ..... C22C 23/00
[52] U.S. Cl. ..... 420/406; 420/405; 420/407; 420/408
[58] Field of Search ..... 420/405, 406, 407, 408

[56] References Cited

U.S. PATENT DOCUMENTS

| | | | |
|---|---|---|---|
| 2,882,145 | 4/1959 | Lucien et al. | 420/406 |
| 3,291,656 | 12/1966 | Mann | 420/408 |
| 4,149,882 | 4/1979 | Unsworth et al. | 75/168 J |
| 4,168,161 | 9/1979 | Unsworth et al. | 75/168 J |
| 4,173,469 | 11/1979 | Unsworth et al. | 75/168 F |
| 4,194,908 | 3/1980 | Unsworth et al. | 75/168 J |
| 4,239,535 | 12/1980 | King et al. | 75/168 D |
| 4,600,661 | 7/1986 | Dohnomoto et al. | 420/408 |
| 4,908,181 | 3/1990 | Das et al. | 420/405 |
| 4,938,809 | 7/1990 | Das et al. | 420/408 |
| 4,997,622 | 3/1991 | Regazzoni et al. | 420/407 |
| 5,087,304 | 2/1992 | Chang et al. | 420/405 |

FOREIGN PATENT DOCUMENTS

| | | | |
|---|---|---|---|
| 1301914 | 5/1967 | Fed. Rep. of Germany | C22C 23/00 |
| 61-4906 | 2/1986 | Japan | C22C 23/00 |
| 664819 | 1/1952 | United Kingdom | C22C 23/06 |
| 1525759 | 9/1978 | United Kingdom | C22C 23/04 |

OTHER PUBLICATIONS

"Standard Specification For Magnesium-Alloy Sand Castings", ASTM Designation: B 80-91, pp. 24-35.
"Standard Specification For Magnesium-Alloy Die Castings", ASTM Designation: B 94-91, pp. 65-69.
"Standard Specification For Magnesium Alloys in Ingot Form", ASTM Designation: B 93M-88, p. 64.

*Primary Examiner*—Upendra Roy
*Attorney, Agent, or Firm*—Finnegan, Henderson, Farabow, Garrett & Dunner

[57] ABSTRACT

A magnesium alloy includes 0.1 to 6.0% by weight of Al, 1.0 to 6.0% by weight of Zn, 0.1 to 3.0% by weight of rare earth element (hereinafter referred to as "R.E."), and balance of Mg and inevitable impurities. By thusly adding Al and Zn, the castability, especially the die-castability, is improved. At the same time, the room temperature strength can be improved because the Mg-Al-Zn crystals having a reduced brittleness are dispersed uniformly in the crystal grains. Further, by adding R.E. as aforementioned, the high temperature strength is improved because the Mg-Al-Zn-R.E. crystals having a higher melting point and being less likely to melt are present in the crystal grain boundaries between the Mg-Al-Zn crystals. This magnesium alloy is excellent in castability, can be die-cast, has a higher tensile strength at room temperature, and is satisfactory in high temperature properties and creep properties. Moreover, when the magnesium alloy includes R.E. in a reduced amount of 0.1 to 2.0% by weight, and further includes 0.1 to 2.0% by weight of Zr and 0.1 to 3.0% by weight of Si, it becomes a magnesium alloy, which is further excellent in the castability, which has a higher tensile strength at room temperature, which is further superb in the high temperature properties and the creep properties, and at the same time whose corrosion resistance is upgraded.

4 Claims, 19 Drawing Sheets ( PRIOR ART )

( PRIOR ART )

HEAT RESISTANT MAGNESIUM ALLOY

BACKGROUND OF THE INVENTION

1. Field of the Invention

The present invention relates to a heat resistant magnesium alloy. More particularly, the present invention relates to a heat resistant magnesium alloy which is superior not only in heat resistance, but also in corrosion resistance, and castability.

2. Description of the Related Art

Magnesium (Mg) has a specific gravity of 1.74, it is the lightest metal among the industrial metallic materials, and it is as good as aluminum alloy in terms of the mechanical properties. Therefore, Mg has been observed as an industrial metallic material which can be used in aircraft, automobiles, or the like, and which can satisfy the light-weight requirements, the fuel-consumption reduction requirements, or the like.

Among the conventional magnesium alloys, an Mg-Al alloy, for instance AM60B, AM50A, AM20A alloys, etc., as per ASTM, includes 2 to 12% by weight of aluminum (Al), and a trace amount of manganese (Mn) is added thereto. In the phase diagram of the Mg-Al alloy, there is a eutectic system which contains alpha-Mg solid solution and beta-$Mg_{17}Al_{12}$ compound in the Mg-rich side. When the Mg-Al alloy is subjected to a heat treatment, there arises age-hardening resulting from the precipitation of the $Mg_{17}Al_{12}$ intermediate phase. Further, the Mg-Al alloy is improved in terms of the strength and the toughness by a solution treatment.

Further, there is an Mg-Al-Zn alloy, for instance an AZ91C alloy or the like as per ASTM, which includes 5 to 10% by weight of Al, and 1 to 3% by weight of zinc (Zn). In the phase diagram of the Mg-Al-Zn alloy, there is a broad alpha solid solution area in the Mg-rich side where Mg-Al-Zn compounds crystallize. The as-cast Mg-Al-Zn alloy is tough and excellent in corrosion resistance, but it is further improved in terms of the mechanical properties by age-hardening. In addition, in the Mg-Al-Zn alloy, the Mg-Al-Zn compounds are precipitated like pearlite in the boundaries by quenching and tempering.

In an as-cast Mg-Zn alloy, a maximum strength and elongation can be obtained when Zn is added to Mg in an amount of 2% by weight. In order to improve the castability and obtain failure-free castings, Zn is added more to Mg. However, an Mg-6% Zn alloy exhibits a tensile strength as low as 17kgf/mm$^2$ when it is as-cast. Although its tensile strength can be improved by the $T_6$ treatment (i.e., an artificial hardening after a solution treatment), it is still inferior to that of the Mg-Al alloy. As the Mg-Zn alloy, a ZCM630A (e.g., Mg-6% Zn-3% Cu-0.2% Mn) has been available.

Furthermore, a magnesium alloy has been investigated which is superior in heat resistance and accordingly which is suitable for high temperature applications. As a result, a magnesium alloy with rare earth element (hereinafter abbreviated to "R.E.") added has been developed. This magnesium alloy has mechanical properties somewhat inferior to those of aluminum alloy at an ordinary temperature, but it exhibits mechanical properties as good as those of the aluminum alloy at a high temperature of from 250° to 300° C. For example, the following magnesium alloys which include R.E. have been put into practical application: an EK30A alloy which is free from Zn (e.g., Mg-2.5 to 4% R.E.-0.2% Zr), and a ZE41A alloy which includes Zn (e.g., Mg-1% R.E.-2% Zn-0.6% Zr). In addition, the following heat resistance magnesium alloys including rare earth element are available: a QE22A alloy which includes silver (Ag) (e.g., Mg-2% Ag-2% Nd-0.6% Zr), and a WE54A alloy which includes yttrium (Y) (e.g., Mg-5% Y-4% Nd0.6% Zr).

The Mg-R.E.-Zr alloy and the Mg-R.E.-Zn-Zr alloy are used as a heat resistance magnesium alloy in a temperature range up to 250° C. For instance, in a ZE41A alloy (e.g., Mg-4% Zn-1% R.E.-0.6% Zr ), since $Mg_{20}Zn_5R.E._2$ crystals are present in the crystal grain boundaries, it is possible to obtain mechanical properties which are as good as those of the aluminum alloy at a high temperature of from 250° to 300° C. FIG. 14 illustrates tensile creep curves which were exhibited by an AZ91C alloy (e.g., Mg-9% Al-1% Zn) and the ZE41A alloy at a testing temperature of 423 K. and under a stress of 63 MPa. It is readily understood from FIG. 14 that the ZE41A alloy was far superior to the AZ91C alloy in terms of the creep resistance.

However, a magnesium alloy has been longed for which has a high creep limit at further elevated temperatures and which has a great fatigue strength as well. Accordingly, an Mg-thorium (Th) alloy has been developed. This Mg-Th alloy has superb creep properties at elevated temperatures, and it endures high temperature applications as high as approximately 350° C. For example, an Mg-Th-Zr alloy and an Mg-Th-Zn-Zr alloy are used in both casting and forging, and both of them have superb creep strengths when they are as cast or when they are subjected to the $T_6$ treatment after extrusion.

Among the above-described magnesium alloys, the Mg-Al or Mg-Al-Zn alloy is less expensive in the costs, it can be die-cast, and it is being employed gradually in members which are used at a low temperature of 60° C. at the highest. However, since the Mg-Al alloy has a low melting point and since it is unstable at elevated temperatures, its high temperature strength deteriorates and its creep resistance degrade considerably at high temperatures.

For instance, the tensile strength of the AZ91C alloy (i.e., one of the Mg-Al-Zn alloys) was measured in a temperature range of from room temperature to 250° C., and the results are illustrated in FIG. 1. The tensile strength of the AZ91C alloy deteriorated as the temperature was raised. Namely, the tensile strength dropped below 25 kgf/mm$^2$ at 100° C., and it deteriorated as low as 10 kgf/mm$^2$ at 250° C. In addition, the creep deformation amount of the AZ91C alloy was also measured under a load of 6.5 kgf/mm$^2$ in an oven whose temperature was raised to 150° C., and the results are illustrated in FIG. 2. As can be seen from FIG. 2, the creep deformation amount of the AZ91C alloy which was as-cast reached 1.0% at 100 hours and the creep deformation amount of the AZ91C alloy which was further subjected to the $T_6$ treatment reached 0.6% at 100 hours, respectively.

Further, since the AZ91C alloy (e.g., Mg-9% Al-1% Zn) of the Mg-Al-Zn alloys has the high Al content, it gives a favorable molten metal flow and accordingly it is superior in castability. However, since the alpha-solid solution crystallizes like dendrite during the solidifying process, the AZ91C alloy suffers from a problem that shrinkage cavities are likely to occur. The shrinkage cavities often become origins of fracture. FIG. 11 is a microphotograph and shows an example of a metallic structure which is fractured starting at a shrinkage cavity. FIG. 12 is a schematic illustration of the microphotograph of FIG. 11 and illustrates a position of the shrinkage cavity.

Furthermore, since the $Mg_{17}Al_{12}$ compounds crystallize in the grain boundaries in the Mg-Al or Mg-Al-Zn alloy and since the compounds are unstable at elevated temperatures, the high temperature strength of the alloy deteriorates and the creep resistance thereof degrades considerably at high temperatures. FIG. 13 illustrates tensile creep curves which were exhibited by the AZ91C alloy (e.g., Mg-9% Al-1% Zn) at testing temperatures of 373 K., 393 K. and 423 K. and under a stress of 63 MPa. It is readily understood from FIG. 13 that the creep strain of the alloy increased remarkably at 423 K.

Moreover, the AZ91C alloy was subjected to a bolt loosening test, and the results are illustrated in FIG. 4. In the bolt loosening test, a cylindrical test specimen was prepared with an alloy to be tested, the test specimen was tightened with a bolt and a nut at the ends, and an elongation of the bolt was measured after holding the test specimen in an oven whose temperature was raised to 150° C. under a predetermined surface pressure. Thus, an axial force resulting from the expansion of the test specimen is measured directly in the bolt loosing test, and the elongation of the bolt is a simplified criterion of the material creep. As illustrated in FIG. 4, the aluminum alloy and an EQ21A alloy including R.E. exhibited axial force retention rates of 98% and 80%, respectively, after leaving the test specimens in the 150° C. oven for 100 hours under a surface pressure of 6.5 kgf/mm$^2$. On the other hand, the AZ91C alloy of the Mg-Al-Zn alloys exhibited an axial force retention rate deteriorated to 40% after leaving the test specimen under the same conditions.

The ZCM630A alloy (i.e., the Mg-Zn alloy) is less expensive in the costs, and it can be die-cast similarly to the AZ91C alloy (i.e., Mg-Al-Zn alloy). However, the ZCM630A alloy is less corrosion resistant, and it is inferior to the Mg-Al alloy in the ordinary temperature strength as earlier described. This unfavorable ordinary temperature strength can be easily noted from FIG. 1. Namely, as illustrated in FIG. 1, the strength of the ZCM630A alloy was equal to that of the AZ91C alloy at 150° C., and it was somewhat above that of the AZ91C alloy at 250° C. As illustrated in FIG. 2, although the ZCM630A alloy exhibited creep deformation amounts slightly better than the AZ91C alloy did when the test specimens were subjected to a load of 6.5 kgf/mm$^2$ and held in the 150° C. oven, it exhibited a creep deformation amount of approximately 0.4% when 100 hours passed. Thus, it is apparent that the ZCM630A alloy is inferior in terms of the heat resistance.

The EK30A or ZE41A alloy ( i.e., the magnesium alloy including R.E. ) and the QE22A or WE54E alloy (i.e., the heat resistance magnesium alloy including R.E.) give mechanical properties as satisfactory as those of the aluminum alloy at elevated temperatures of from 250° to 300° C. However, as aforementioned, their ordinary temperature strengths are deteriorated by adding R.E. This phenomena can be seen from the fact that the ZE41A alloy exhibited a room temperature strength of about 20 kgf/mm$^2$ as illustrated in FIG. 1.

Therefore, in the EQ21A (or QE22A) alloy and the WE54A alloy, Ag and Y are added in order to improve their room temperature strengths as well as their high temperature strengths. However, these elements added are expensive and deteriorate their castabilities.

In addition, in the magnesium alloys with R.E. added, there arise micro-shrinkages which result in failure. Hence, in the Mg-R.E. alloy, Zr is always added so as to fill the micro-shrinkages and make a complete cast mass. However, the addition of Zr results in hot tearings, and the $Mg_{20}Zn_5R.E._2$ crystals deteriorate the flowability of the molten metal. Accordingly, it is not preferable to add Zr to the magnesium alloys in a grater amount, because such a Zr addition might make the magnesium alloys inappropriate for die casting.

Moreover, as above-mentioned, the Mg-Th alloy is excellent in terms of the high temperature creep properties, and it endures applications at temperatures up to approximately 350° C. However, since Th is a radioactive element, it cannot be used in Japan.

As having been described so far, there have been no magnesium alloys which are excellent in the high temperature properties and the creep properties, which can be die-cast, and which are not so expensive in the costs. Specifically speaking, the AZ91C alloy of the Mg-Al-Zn alloys is superior in the castability, but it is inferior in the high temperature strength and the creep resistance. The ZE41A alloy of the magnesium alloys including R.E. is superb in the heat resistance, but it is poor in the castability.

SUMMARY OF THE INVENTION

The present invention has been developed in order to solve the aforementioned problems of the conventional magnesium alloys. It is therefore a primary object of the present invention to provide a heat resistant magnesium alloy which is superb in high temperature properties and creep properties. It is a further object of the present invention to provide a heat resistant magnesium alloy which can be used as engine component parts or drive train component parts to be exposed to a temperature of up to 150° C., which enables mass production by die casting, which requires no heat treatments, and which is available at low costs. In particular, it is a furthermore object of the present invention to provide a heat resistant magnesium alloy whose castability is enhanced while maintaining the high temperature resistance and the creep resistance as good as those of the ZE41A alloy, and at the same time whose corrosion resistance is improved.

In order to solve the aforementioned problems, the present inventors investigated the addition effects of the elements based on the test data of the conventional gravity-cast magnesium alloys, and they researched extensively on what elements should be included in an alloy system and on what alloy systems should be employed. As a result, they found out the following: Ag is effective on the room temperature strength and the creep resistance, but it adversely affects the corrosion resistance and the costs. Y is effective on the room temperature strength and the creep resistance, but it adversely affects the die-castability and the costs. Cu adversely affects the corrosion resistance. Zr is effective on the room temperature strength and the creep resistance, but too much Zr addition adversely affects the die-castability and the costs. Hence, they realized that they had better not include these elements in an alloy system unless they are needed.

Further, the present inventors continued to research on the remaining 3 elements, e.g., Al, R.E. and Zn, and consequently they found out the following: Although Al adversely affects the creep resistance, it is a required element to ensure the room temperature strength and the die-castability. Although R.E. deteriorates the room temperature strength and adversely affects the die-castability and the costs, it is a basic element to improve the high temperature properties and the creep resistance. Although Zn more or less troubles the creep resistance and the die-castability, it is needed in order to maintain the room temperature strength and to reduce the costs. As a result, they reached a conclusion that an Mg-Al-Zn-R.E. alloy system has effects on solving the aforementioned problems of the conventional magnesium alloys.

Furthermore, the present inventors examined a cast metallic structure of the Mg-Al-Zn-R.E. alloy, and they noticed the following facts anew: Mg-Al-Zn mesh-shaped crystals are uniformly dispersed in the crystal grains, and these Mg-Al-Zn crystals improve the room temperature strength. In addition, Mg-Al-Zn-R.E. plate-shaped crystals are present in the crystal grain boundaries between the Mg-Al-Zn crystals, and these Mg-Al-Zn-R.E. crystals improve the high temperature resistance. FIG. 8 is a microphotograph of the metallic structure of the Mg-Al-Zn-R.E. magnesium alloy, and FIG. 9 is a partly enlarged schematic illustration of FIG. 8. As can be appreciated well from FIGS. 8 and 9, the Mg-Al-Zn mesh-shaped crystals are uniformly dispersed in the crystal grains, and Mg-Al-Zn-R.E. plate-shaped crystals are present in the crystal grain boundaries between the Mg-Al-Zn crystals.

Therefore, the present inventors decided to investigate the optimum compositions which give the maximum axial force retention rate to the Mg-Al-Zn-R. E. alloy. Namely, they determined the addition levels of the elements from the possible maximum addition amounts of these 3 elements (i.e., Al, Zn and R.E.), they measured the axial force retention rates of the test specimens which were made in accordance with the combinations of the concentrations of the elements taken as factors, they indexed the thus obtained data in an orthogonal table, they carried out a variance analysis on the data of the axial force retention rates in order to estimate the addition effects of the elements. As a result, they ascertained that 2% of R.E., 4% of Al and 2% of Zn are the optimum compositions.

In accordance with the determination of the optimum compositions, the present inventors went on determining composition ranges of the 3 elements. Namely, they fixed 2 of the 3 elements at the optimum compositions, and they varied addition amount of the remaining 1 element so as to prepare a variety of the Mg-Al-Zn-R.E. alloys. Finally, they measured the thus prepared Mg-Al-Zn-R.E. alloys for their tensile strengths at room temperature and 150° C. The resulting data are illustrated in FIGS. 5 through 7. FIG. 5 shows the tensile strengths of the Mg-Al-Zn-R.E. alloys in which the content of Al was varied, FIG. 6 shows the tensile strengths of the Mg-Al-Zn-R.E. alloys in which the content of Zn was varied, and FIG. 7 shows the tensile strengths of the Mg-Al-Zn-R.E. alloys in which the content of R.E. was varied. Based on the data shown in FIGS. 5 through 7, they searched for the composition ranges which give increased tensile strengths at room temperature and at 150° C. Consequently, they obtained the following composition ranges: 0.1 to 6.0% by weight of Al, 1.0 to 6.0% by weight of Zn and 0.1 to 3.0% by weight of R.E. Thus, the present inventors could complete the present invention. In addition, they set up an optimum target performance so that the Mg-Al-Zn-R.E. alloys exhibit a tensile strength of 240 MPa or more at room temperature and a tensile strength of 200 MPa or more at 150° C., and they also searched for the composition ranges which conform to the optimum target performance. Finally, they found that the following composition ranges which can satisfy the optimum target performance: 2.0 to 6.0% by weight of Al, 2.6 to 6.0% by weight of Zn and 0.2 to 2.5% by weight of R.E.

A heat resistant magnesium alloy of the present invention consists essentially of: 0.1 to 6.0% by weight of Al; 1.0 to 6.0% by weight of Zn; 0.1 to 3.0% by weight of R.E.; and balance of Mg and inevitable impurities.

Since the present heat resistant magnesium alloy includes 0.1 to 6.0% by weight of Al and 1.0 to 6.0% by weight of Zn, the castability, especially the die-castability, is improved. Although the present heat resistant magnesium alloy includes R.E., the room temperature strength can be improved at the same time. This advantageous effect results from the metallic structure arrangement wherein the Mg-Al-Zn crystals, whose brittleness is improved with respect to that of the crystals of the conventional magnesium alloys, are dispersed uniformly in the crystal grains.

Further, since the present heat resistant magnesium alloy includes 0.1 to 3.0% by weight of R.E. in addition to Al and Zn, the high temperature strength is improved. This advantageous effect results from the metallic structure arrangement wherein the Mg-Al-Zn-R.E. crystals, whose melting points are higher than those of the crystals of the conventional magnesium alloys and which are less likely to melt than the conventional crystals, are present in the crystal grain boundaries between the Mg-Al-Zn crystals. Thus, the present magnesium alloy is excellent in its castability so that it can be die-cast, it has a high tensile strength at room temperature, and it is superb in the high temperature properties and the creep properties.

The reasons why the composition ranges of the present heat resistant magnesium alloy are limited as set forth above will be hereinafter described.

0.1 to 6.0% by weight of Al

When Al is added to magnesium alloy, the room temperature strength of the magnesium alloy is improved, and at the same time the castability thereof is enhanced. In order to obtain these advantageous effects, it is necessary to include Al in an amount of 0.1.% by weight or more. However, when Al is included in a large amount, the high temperature properties of the magnesium alloy are deteriorated. Accordingly, the upper limit of the Al composition range is set at 6.0% by weight. It is further preferable that the present magnesium alloy includes Al in an amount of 2.0 to 6.0% by weight so as to satisfy the above-mentioned optimum target performance. Additionally, when the upper limit of the Al composition range is set at 5.0% by weight, the present heat resistant magnesium alloy is furthermore improved in terms of the tensile strengths at room temperature and at 150° C.

1.0 to 6.0% by weight of Zn

Zn improves the room temperature strength of magnesium alloy, and it enhances the castability thereof as well. In order to obtain these advantageous effects, it is necessary to include Zn in an amount of 1.0% by weight or more. However, when Zn is included in a large amount, the high temperature properties of the magnesium alloy are deteriorated, and the magnesium alloy becomes more likely to suffer from hot tearings. Accordingly, the upper limit of the Zn composition range is set at 6.0% by weight. It is further preferable that the present magnesium alloy includes Zn in an amount of 2.6 to 6.0% by weight so as to satisfy the above-mentioned optimum target performance.

0.1 to 3.0% by weight of R.E.

R.E. is an element which improves the high temperature strength and the creep resistance of magnesium alloy. In order to obtain these advantageous effects, it is necessary to include R.E. in an amount of 0.1% by weight or more. However, when R.E. is included in a large amount, the castability of the magnesium alloy is deteriorated, and the costs thereof are increased. Accordingly, the upper limit of the R.E. composition range is set at 3.0% by weight. In particular, it is preferable that R.E. is a misch metal which includes cerium (Ce) at least. It is further preferable that the present heat resistant magnesium alloy includes R.E. in an amount of 0.2 to 2.5% by weight so as to satisfy the above-mentioned optimum target performance, and that the misch metal includes Ce in an amount of 45 to 55% by weight. Additionally, when the upper limit of the R.E. composition range is set at 2.0% by weight, the present heat resistant magnesium alloy is furthermore improved in terms of the tensile strengths at room temperature and at 150° C. as well as the castability.

As having been described so far, the present heat resistant magnesium alloy consists essentially of: 0.1 to 6.0% by weight of Al; 1.0 to 6.0% by weight of Zn; 0.1 to 3.0% by weight of R.E.; and balance of Mg and inevitable impurities. By thusly adding Al and Zn, the castability, especially the die-castability, is improved. At the same time, the room temperature strength can be improved because the Mg-Al-Zn crystals whose brittleness is improved with respect to that of the crystals of the conventional magnesium alloys are dispersed uniformly in the crystal grains. Further, by adding R.E. together with Al and Zn as aforementioned, the high temperature strength is improved because the Mg-Al-Zn-R.E. crystals whose melting point is higher than that of the crystals of the conventional magnesium alloys and which are less likely to melt than the conventional crystals do are present in the crystal grain boundaries between the Mg-Al-Zn crystals. Thus, the present heat resistant magnesium alloy is a novel magnesium alloy which is excellent in the castability, which can be diecast, which has the high tensile strength at room temperature, and which is superb in the high temperature properties and the creep properties.

In addition, the present inventors continued earnestly to extensively investigate the improvement of the castability of the present heat resistant magnesium alloy while keeping the optimum high temperature strength and creep resistance thereof. Hence, they thought of adding Al to an alloy which was based on the ZE41A alloy, and they found more appropriate composition ranges which not only provide improved castability but also to keep the high temperature strength. Specifically speaking, in the more appropriate composition ranges, the content of R.E. affecting the castability is reduced to a composition range which allows the high temperature strength to be maintained, Zr is further included as little as possible so as not to adversely affect the castability and costs but to enhance the room temperature strength and creep resistance, and Si is further included so as to improve the creep resistance. Thus, the present inventors could complete a modified version of the present heat resistant magnesium alloy which has a further improved heat resistance, corrosion resistance and castability.

The modified version of the present heat resistant magnesium alloy consists essentially of: 0.1 to 6.0% by weight of Al; 1.0 to 6.0% by weight of Zn; 0.1 to 2.0% by weight of R.E.; 0.1 to 2.0% by weight of Zr; 0.1 to 3.0% by weight of Si; and balance of Mg and inevitable impurities.

Since the modified version of the present heat resistant magnesium alloy includes R.E. in a content which is reduced in so far as the optimum high temperature strength can be maintained, it is a magnesium alloy which is excellent in the castability, which has a high tensile strength at room temperature, and which is superb in the high temperature properties and the creep properties. As described later, R.E. forms a R.E.-rich protective film during initial corrosion, and accordingly it also improves the corrosion resistance of the magnesium alloy.

Further, since the modified version of the present heat resistant magnesium alloy includes Zr in an amount of 0.1 to 2.0% by weight, its room temperature strength and the high temperature strength are enhanced without deteriorating its castability. Furthermore, since it includes Si in an amount of 0.1 to 3.0% by weight, its creep resistance is upgraded.

The reasons why the composition ranges of the modified version of the present heat resistant magnesium alloy are limited as set forth above will be hereinafter described. However, the reasons for the limitations on the Al, Zn and R.E. composition ranges will not be set forth repeatedly hereinafter, because they are the same as those for the abovedescribed present heat resistant magnesium alloy.

0.1 to 2.0% by weight of Zr

Zr improves the room temperature strength and the high temperature strength of magnesium alloy. In order to obtain these advantageous effects, it is necessary to include Zr in an amount of 0.1% by weight or more. However, when Zr is included in a large amount, the castability is degraded, thereby causing hot tearings. Accordingly, the upper limit of the Zr composition range is set at 2.0% by weight. It is further preferable that the modified version of the present heat resistant magnesium alloy includes Zr in an amount of 0.5 to 1.0% by weight.

0.1 to 3.0% by weight of Si

Si improves the creep resistance of magnesium alloy. This is believed as follows: Micro-fine $Mg_2Si$ is precipitated when the magnesium alloy is subjected to the T4 treatment (i.e., a natural hardening to a stable state after a solution treatment), and this $Mg_2Si$ hinders the dislocation. However, when Si is included in a large amount, the castability of the magnesium alloy is deteriorated, thereby causing hot tearings. Accordingly, the upper limit of the Si composition range is set at 3.0% by weight. It is further preferable that the modified version of the present heat resistant magnesium alloy includes Si in an amount of 0.5 to 1.5% by weight.

Thus, the modified version of the present heat resistant magnesium alloy consists essentially of: 0.1 to 6.0% by weight of Al; 1.0 to 6.0% by weight of Zn; 0.1 to 2.0% by weight of R.E.; 0.1 to 2.0% by weight of Zr; 0.1 to 3.0% by weight of Si; and balance of Mg and inevitable impurities. In addition to the above-described operations and advantageous effects of the present heat resistant magnesium alloy, the modified version of the present heat resistant magnesium alloy effects the following advantageous effects: By reducing the R.E. content to the extent that the optimum high temperature strength can be maintained, the modified version becomes a magnesium alloy, which is further excellent in the castability, and which has a higher tensile strength at room temperature, and which is further superb in the high temperature properties and the creep properties. Further, R.E. forms the R.E.-rich protective film during initial corrosion, and accordingly it also improves the corrosion resistance of the modified version. Furthermore, by including Zr in the aforementioned amount, the room temperature strength and the high temperature strength of the modified version are enhanced without deteriorating the castability. In addition, by including Si in the aforementioned amount, the creep resistance of the modified version is upgraded.

As a result, the modified version of the present heat resistant magnesium alloy is adapted to be a novel magnesium alloy whose castability is improved while maintaining the high temperature resistance and the creep resistance as good as those of the ZE41A alloy, and at the same time whose corrosion resistance is upgraded. Thus, the modified version is exceptionally good in terms of the heat resistance and the corrosion resistance. Hence, the modified version can be applied to engine component parts which are required to have these properties, especially to intake manifolds which are troubled by the corrosion resulting from the concentration of the EGR (exhaust gas re-circulation) gas, and accordingly automobile can be light-weighted remarkably. Since the castability of the modified version is far superior to those of the conventional heat resistant magnesium alloys, it can be cast by using a mold. Therefore, engine component parts, e.g., intake manifolds or the like having complicated configurations, can be mass-produced with the modified version.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

Preferred embodiments of the heat resistant magnesium alloy according to the present invention will be hereinafter described together with the conventional magnesium alloys or comparative examples in order to demonstrate the advantageous effects of the present invention.

First Preferred Embodiment

As a First Preferred Embodiment of the heat resistant magnesium alloy according to the present invention, a magnesium alloy was prepared which comprised 4.2% by weight of Al, by weight of Zn, 1.9% by weight of R.E., and balance of Mg and inevitable impurities. This composition range fell in the composition range of the present heat resistant magnesium alloy. This magnesium alloy was melted and processed into test specimens by die casting with a hot chamber at a casting temperature of 690° C., at mold temperatures of 80° to 120° C. and under a casting pressure of 300 kgf/cm$^2$. These test specimens had a dumbbell-shaped configuration and dimensions in accordance with ASTM "80–91," paragraph 12.2.1.

The resulting test specimens were subjected to the high temperature tensile test and the tensile creep test. The high temperature tensile test was carried out so as to measure the tensile strengths of the test specimens at temperatures from room temperature to 250° C. The tensile creep test was carried out in order to measure the creep deformation amounts of the test specimens at testing times up to 100 hours when the test specimens were subjected to a load of 6.5 kgf/mm$^2$ and held in the 150° C. oven. The thus obtained results are illustrated in FIGS. 1 and 2 together with the results obtained for the conventional magnesium alloys.

Figure 1:
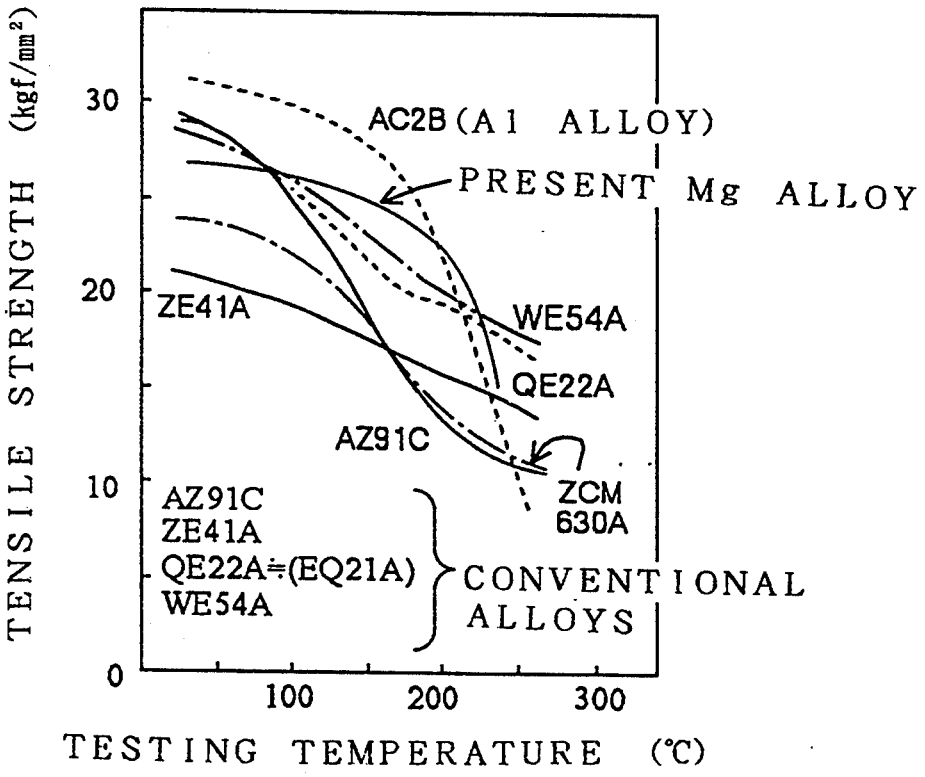
FIG. 1 is a graph illustrating the results of a high temperature tensile strength test to which the heat resistant magnesium alloy according to the present invention and the conventional magnesium alloys were subjected.

FIG. 1 is a graph illustrating the results of the high temperature tensile strength test to which the present heat resistant magnesium alloy and the conventional magnesium alloys were subjected. It is readily understood from FIG. 1 that the room temperature tensile strength of the present heat resistant magnesium alloy was approximately 27 kgf/mm$^2$, and that it was higher than that of the ZCM630A alloy. Thus, the present heat resistant magnesium alloy exhibited a sufficient tensile strength at room temperature. Further, the present magnesium alloy exhibited a tensile strength which decreased gradually as the temperature increased, but, at around 100° C., the strength became equal to those of the WE54A, QE22A and AZ91AC alloys (i.e., the conventional magnesium alloys) which exhibited higher tensile strengths than that of the present heat resistant magnesium alloy at room temperature. Likewise, in a range between 100° and 150° C., the tensile strength decreased gradually. However, the present heat resistant magnesium exhibited a remarkably higher strength than those of the WE54A, QE22A and AZ91AC alloys in the temperature range. At 150° C., the present heat resistant magnesium alloy exhibited a tensile strength of approximately 24 kgf/mm$^2$. Thus, it was verified that the advantageous effect was obtained at which the present invention aimed.

Figure 2:
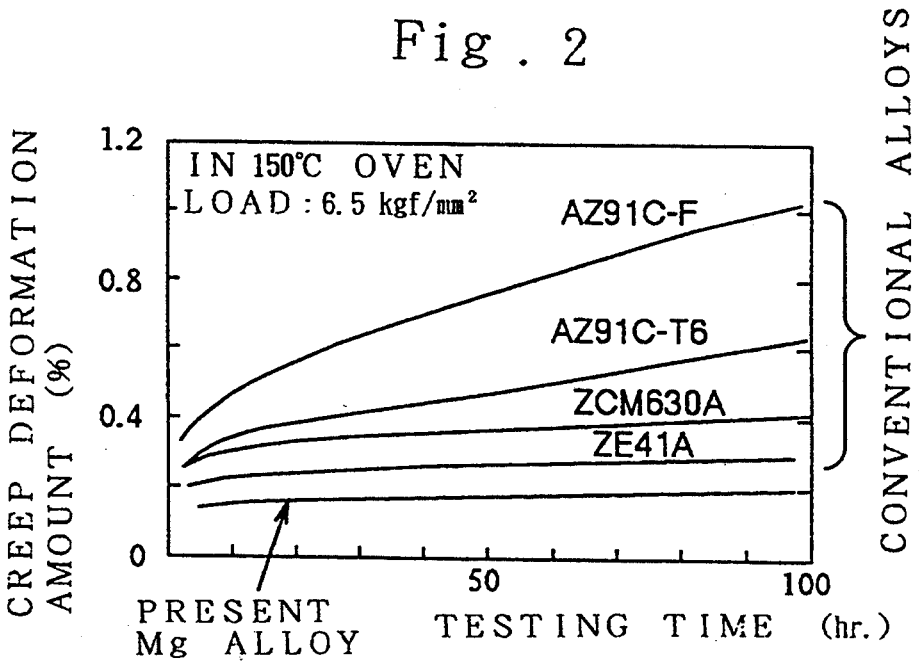
FIG. 2 is a graph illustrating the results of a tensile creep test to which the present heat resistant magnesium alloy and the conventional magnesium alloys were subjected.

FIG. 2 is a graph illustrating the results of the tensile creep test to which the present heat resistant magnesium alloy and the conventional magnesium alloys were subjected. The present magnesium alloy deformed in a creep deformation amount less than the ZCM630A and ZE41A alloys (i.e., the conventional magnesium alloys ) did. Namely, the present magnesium alloy deformed in a creep deformation amount of as less as 0.2% at 100 hours. Consequently, it was assumed that a bolt axial force retention rate of 70 to 80% could be obtained when the cylindrical test specimen was made with the present heat resistant magnesium alloy and subjected to the bolt loosing test. Thus, another advantageous effect of the present invention was verified.

Figure 22:
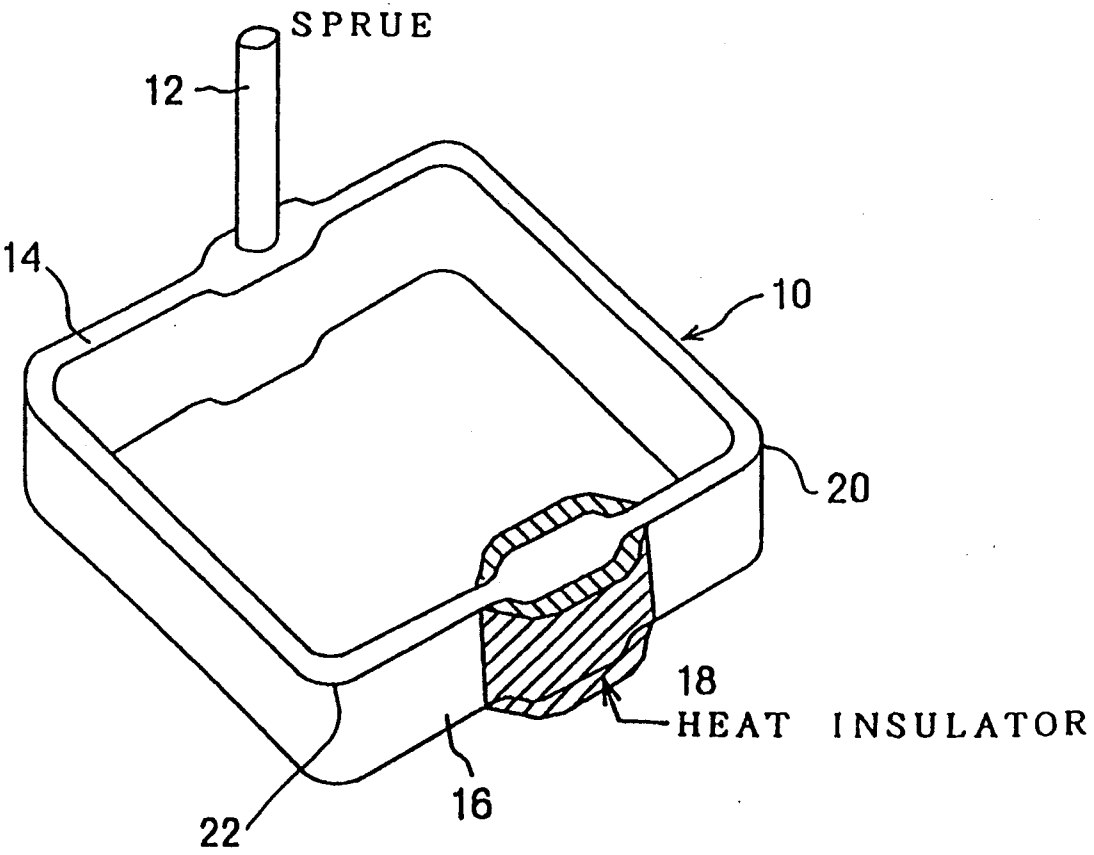
FIG. 22 is a perspective view of a test specimen which was prepared for the die cast hot tearings occurrence test.

In addition, in order to compare the die-castability of the present heat resistant magnesium alloy with those of the conventional magnesium alloys, test specimens were prepared with the present heat resistant magnesium alloy and the AZ91C, ZE41A and EQ21A alloys by die casting under an identical casting conditions, and they were examined for their die cast hot tearings occurrences. The test specimens had a configuration and dimensions as illustrated in FIG. 22, and they were evaluated for their die cast hot tearings occurrence rates at their predetermined corners as later described in detail in the "Fifth Preferred Embodiment" section. The thus obtained results are summarized and illustrated in FIG. 3.

Figure 3:
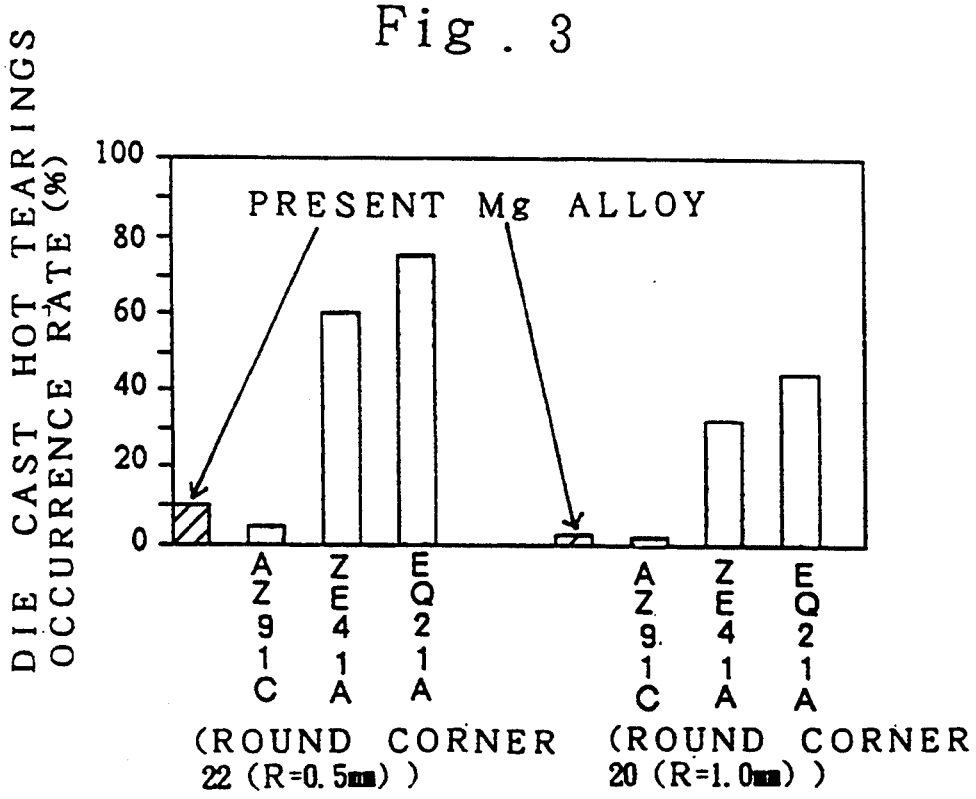
FIG. 3 is a bar graph illustrating the results of a die cast hot tearings occurrence test to which the present heat resistant magnesium alloy and the conventional magnesium alloys were subjected.
Figure 4:
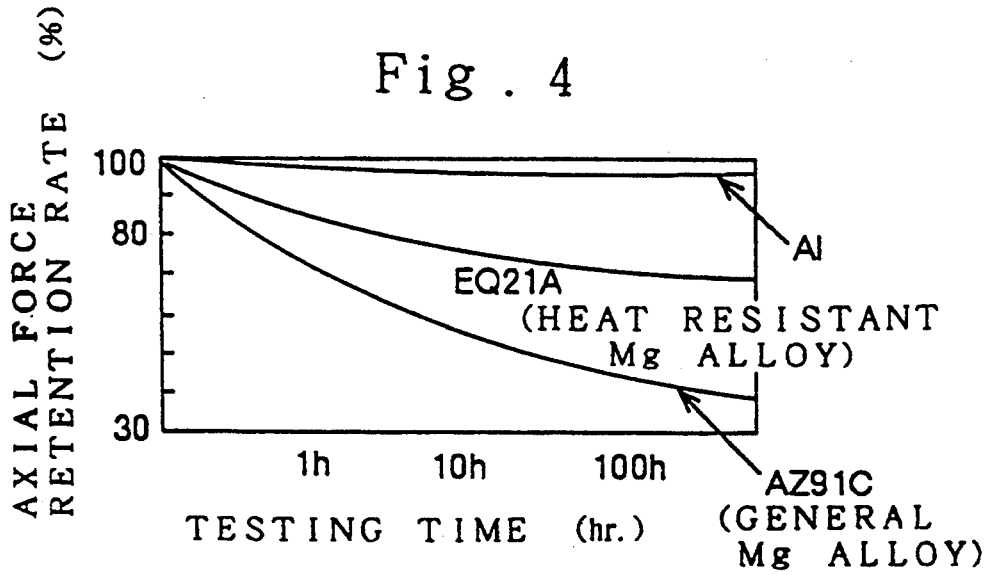
FIG. 4 is a graph illustrating the results of a bolt loosening test to which the conventional magnesium alloys were subjected.

As can be appreciated from FIG. 3, the conventional alloys including Zr, e.g., the ZE41A and EQ21A alloys, exhibited die cast hot tearings occurrence rates of 40 to 80%, and the conventional AZ91C alloy being free from Zr exhibited a die cast hot tearings occurrence rate of 2 to 5%. On the other hand, the present heat resistant magnesium alloy exhibited a die cast hot tearings occurrence rate of 4 to 10% which was remarkably less than those of the ZE41A and EQ21A alloys but which was slightly worse than that of the AZ91C alloy. Thus, the present heat resistant magnesium alloy was confirmed to be a heat resistant magnesium alloy having an excellent castability.

Second Preferred Embodiment

Magnesium alloys having the following chemical compositions as set forth in Table 1 below were melted and processed into test specimens by die casting with a hot chamber at a casting temperature of 690° C., at mold temperatures of 80° to 120° C. and under a casting pressure of 300 kgf/cm$^2$. These test specimens had a dumbbell-shaped configuration and dimensions in accordance with ASTM "80–91," paragraph 12.2.1.

TABLE 1

| Classification | I.D. No. | Chemical Components (% by weight) Al | Zn | R.E. |
|---|---|---|---|---|
| Pref. | 1 | 2 | 4 | 2 |
| Embodiment | 2 | 4 | 4 | 2 |
| | 3 | 6 | 4 | 2 |
| Comp. | 4 | 0 | 4 | 2 |
| Ex. | 5 | 8 | 4 | 2 |
| Pref. | 6 | 4 | 2 | 2 |
| Embodiment | 7 | 4 | 4 | 2 |
| | 8 | 4 | 6 | 2 |
| Comp. | 9 | 4 | 0 | 2 |
| Ex. | 10 | 4 | 8 | 2 |
| Pref. | 11 | 4 | 4 | 3 |
| Embodiment | 12 | 4 | 4 | 2 |
| Comp. | 13 | 4 | 4 | 0 |
| Ex. | 14 | 4 | 4 | 4 |

In Table 1 above, identification (I.D.) Nos. 1 through 5 are the magnesium alloys in which the Zn contents were fixed at 4.0% by weight, the R.E. contents were fixed at 2.0% by weight, and the Al contents were varied. The magnesium alloys with I.D. Nos. 1 through 3 are the present heat resistant magnesium alloys whose Al contents fell in the composition range according to the present invention, the magnesium alloy with I.D. No. 4 is a comparative example which was free from Al, and the magnesium alloy with I.D. No. 5 is a comparative example which included Al in an amount more than the present composition range.

Further, I.D. Nos. 6 through 10 are the magnesium alloys in which the Al contents were fixed at 4.0% by weight, the R.E. contents were fixed at 2.0% by weight, and the Zn contents were varied. The magnesium alloys with I.D. Nos. 6 through 8 are the present heat resistant magnesium alloys whose Zn contents fell in the present composition range, the magnesium alloy with I.D. No. 9 is a comparative example which was free from Zn, and the magnesium alloy with I.D. No. 10 is a comparative example which included Zn in an amount more than the present composition range.

Furthermore, I.D. Nos. 11 through 14 are the magnesium alloys in which the Al contents were fixed at 4.0% by weight, the Zn contents were fixed at 4.0% by weight, and the R.E. contents were varied. The magnesium alloys with I.D. Nos. 11 and 12 are the present heat resistant magnesium alloys whose R.E. contents fell in the present composition range, the magnesium alloy with I.D. No. 13 is a comparative example which was free from R.E., and the magnesium alloy with I.D. No. 14 is a comparative example which included R.E. in an amount more than the present composition range.

Figure 5:
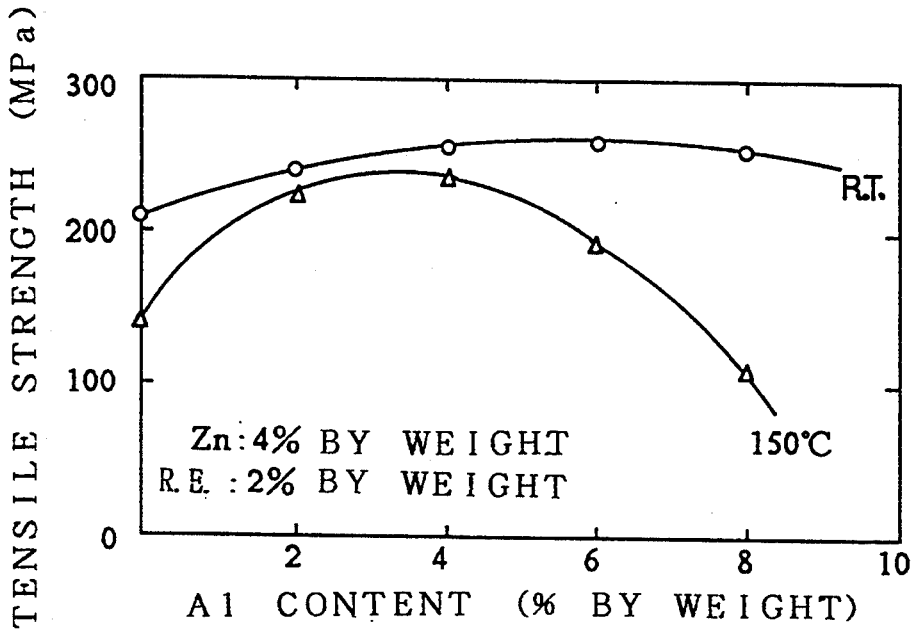
FIG. 5 is a graph illustrating the relationships between the tensile strengths at room temperature as well as at 150° C. and the Al contents of the present heat resistant magnesium alloys.
Figure 6:
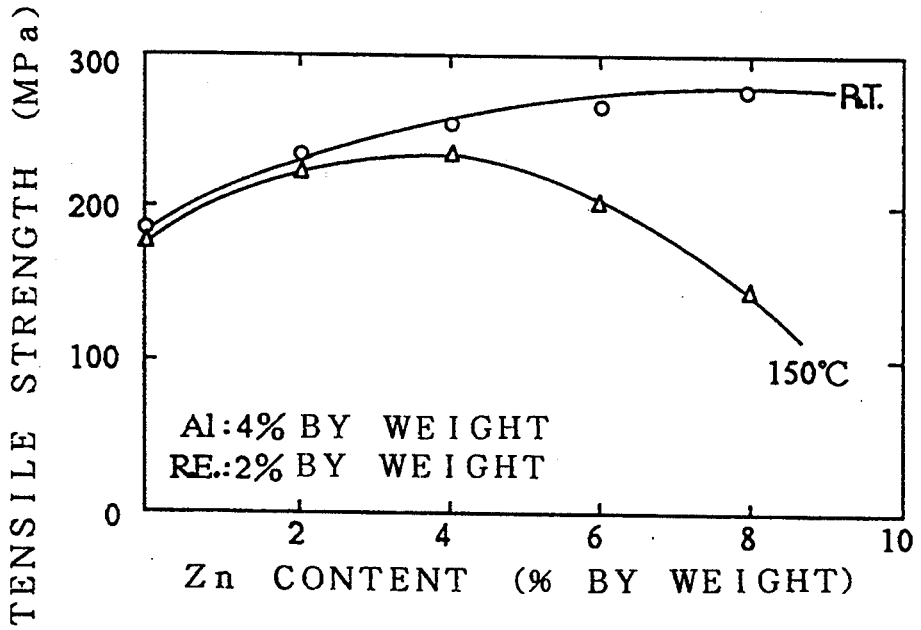
FIG. 6 is a graph illustrating the relationships between the tensile strengths at room temperature as well as at 150° C. and the Zn contents of the present heat resistant magnesium alloys.
Figure 7:
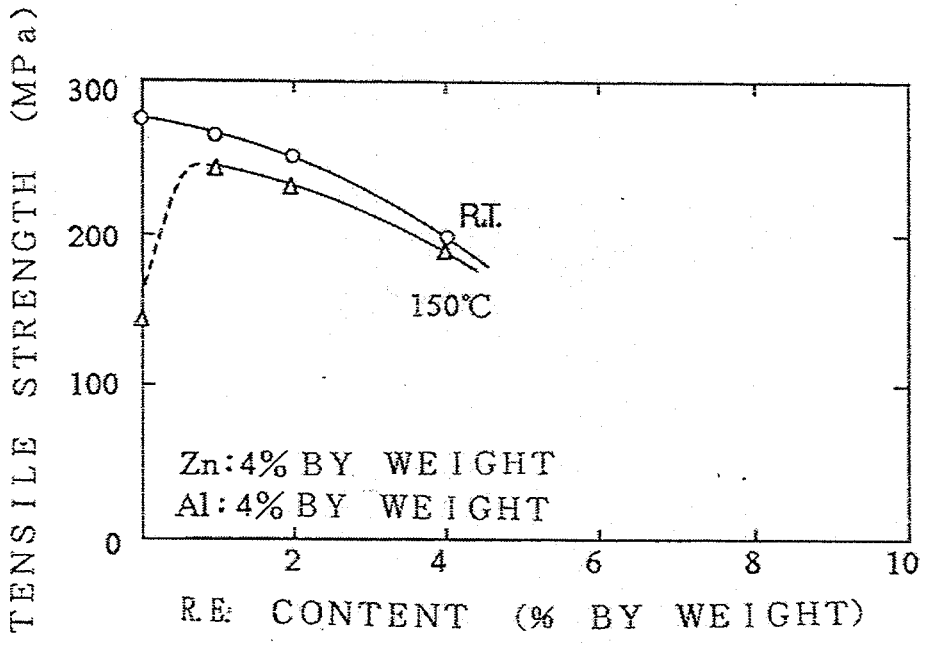
FIG. 7 is a graph illustrating the relationships between the tensile strengths at room temperature as well as at 150° C. and the R.E. contents of the present heat resistant magnesium alloys.
Figure 8:
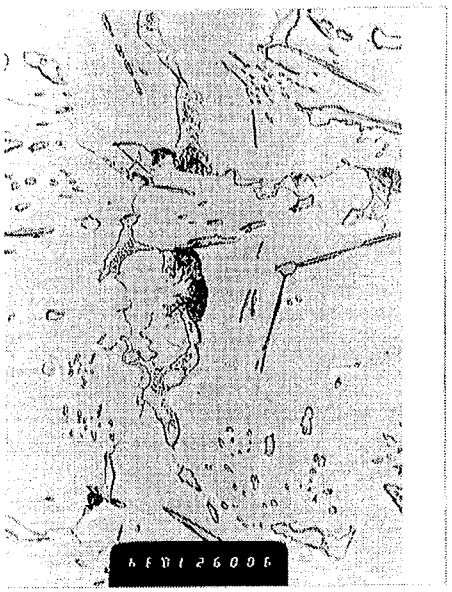
FIG. 8 is a microphotograph showing the metallic structure of the present heat resistant magnesium alloy.
Figure 9:
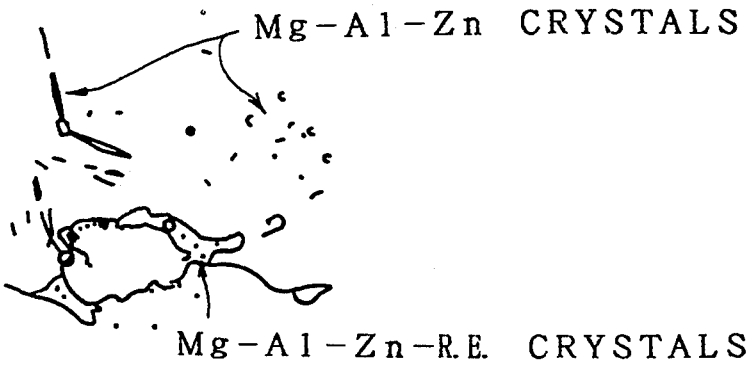
FIG. 9 is a partly enlarged schematic illustration of the metallic structure of FIG. 8.

The resulting test specimens were examined for their tensile strengths at room temperature and at 150° C. The results of this measurement are illustrated in FIGS. 5 through 7. In particular, FIG. 5 illustrates the examination results on the magnesium alloys with I.D. Nos. 1 through 5 whose Al contents were varied, FIG. 6 illustrates the examination results on the magnesium alloys with I.D. Nos. 6 through 10 whose Zn contents were varied, and FIG. 7 illustrates the examination results on the magnesium alloys with I.D. Nos. 11 through 14 whose R.E. contents were varied.

As illustrated in FIG. 5, when the Zn contents were fixed at 4.0% by weight and the R.E. contents were fixed at 2.0% by weight, the room temperature tensile strength increased as the Al content increased, and it exceeded 240 MPa when the Al content was about 2.0% by weight. As for the tensile strength at 150° C., it exceeded 200 MPa when the Al content was about 1.0% by weight, and it became maximum when the Al content was about 3.3% by weight. Thereafter, the 150° C. tensile strength decreased as the Al content increased, and it became 200 MPa or less when the Al content exceeded about 6.0% by weight. As a result, in the Al content range of 2.0 to 6.0% by weight, the present heat resistant magnesium alloys were verified to exhibit a room temperature tensile strength of 240 MPa or more and a 150° C. tensile strength of 200 MPa or more.

Further, as illustrated in FIG. 6, when the Al contents were fixed at 4.0% by weight and the R.E. contents were fixed at 2.0% by weight, the room temperature tensile strength increased as the Zn content increased, and it exceeded 240 MPa when the Zn content was about 2.6% by weight. As for the tensile strength at 150° C., it exceeded 200 MPa when the Zn content was about 1.0% by weight, and it became maximum when the Zn content was about 4.0% by weight. Thereafter, the 150° C. tensile strength decreased as the Zn content increased, and it became 200 MPa or less when the Zn content exceeded about 6.0% by weight. As a result, in the Zn content range of 2.6 to 6.0% by weight, the present heat resistant magnesium alloys were verified to exhibit a room temperature tensile strength of 240 MPa or more and a 150° C. tensile strength of 200 MPa or more.

Furthermore, as illustrated in FIG. 7, when the Al contents were fixed at 4.0% by weight and the Zn contents were fixed at 4.0% by weight, the room temperature tensile strength decreased as the R.E. content increased, and it became 240 MPa or less when the R.E. content exceeded about 2.5% by weight. As for the tensile strength at 150° C., it became higher sharply when the R.E. content was up to about 0.8% by weight, and it gradually decreased as the R.E. content increased. Finally, the 150° C. tensile strength became 200 MPa or less when the R.E. content exceeded about 3.6% by weight. As a result, in the R.E. content range of 0.2 to 2.5% by weight, the present heat resistant magnesium alloys were verified to exhibit a room temperature tensile strength of 240 MPa or more and a 150° C. tensile strength of 200 MPa or more.

First Evaluation

The magnesium alloy with I.D. No. 1 which was adapted to be the preferred embodiment of the present invention in the "Second Preferred Embodiment" section was melted and processed into a cylindrical test specimen by die casting with a hot chamber at a casting temperature of 690° C., at mold temperatures of 80° to 120° C. and under a casting pressure of 300 kgf/cm$^2$. This cylindrical test specimen was tightened with a bolt and a nut at the ends, it was held in an oven whose temperature was raised to 150° C. for 100 hours, and thereafter an elongation of the bolt was measured in order to examine an axial force retention rate of the test specimen. The thus examined axial force retention rate was 80%. Accordingly, it was verified that the present heat resistant magnesium alloy provided a satisfactory axial force retention rate.

Third Preferred Embodiment

Magnesium alloys having the following chemical compositions as set forth in Table 2 below were melted and processed into test specimens by gravity casting at a casting temperature of 690° C. and at mold temperatures of 80° to 120° C. These test specimens had a dumb-bell-shaped configuration and dimensions in accordance with ASTM "80–91," paragraph 12.2.1.

TABLE 2

| Classification | I.D. No. | Chemical Components (% by weight) Al | Zn | R.E. | Zr | Si |
|---|---|---|---|---|---|---|
| Pref. Embodiment | 15 | 2 | 4 | 2 | 0.4 | 0.3 |
| | 16 | 4 | 4 | 2 | 0.4 | 0.3 |
| | 17 | 6 | 4 | 2 | 0.4 | 0.3 |
| Comp. Ex. | 18 | 0 | 4 | 2 | 0.4 | 0.3 |
| | 19 | 8 | 4 | 2 | 0.4 | 0.3 |
| Pref. Embodiment | 20 | 4 | 2 | 2 | 0.4 | 0.3 |
| | 21 | 4 | 4 | 2 | 0.4 | 0.3 |
| | 22 | 4 | 6 | 2 | 0.4 | 0.3 |
| Comp. Ex. | 23 | 4 | 0 | 2 | 0.4 | 0.3 |
| | 24 | 4 | 8 | 2 | 0.4 | 0.3 |
| Pref. Embodiment | 25 | 4 | 4 | 1 | 0.4 | 0.3 |
| | 26 | 4 | 4 | 2 | 0.4 | 0.3 |
| Comp. Ex. | 27 | 4 | 4 | 0 | 0.4 | 0.3 |
| | 28 | 4 | 4 | 4 | 0.4 | 0.3 |
| Pref. Embodiment | 29 | 4 | 4 | 1 | 0.4 | 1.0 |

In Table 2 above, I.D. Nos. 15 through 19 are the magnesium alloys in which the Zn contents were fixed at 4.0% by weight, the R.E. contents were fixed at 2.0% by weight, the Zr contents were fixed at 0.4% by weight, the Si contents were fixed at 0.3% by weight, and the Al contents were varied. The magnesium alloys with I.D. Nos. 15 through 17 are the modified present heat resistant magnesium alloys whose Al contents fell in the composition range according to the present invention, the magnesium alloy with I.D. No. 18 is a comparative example which was free from Al, and the magnesium alloy with I.D. No. 19 is a comparative example which included Al in an amount more than the present composition range.

Further, I.D. Nos. 20 through 24 are the magnesium alloys in which the Al contents were fixed at 4.0% by weight, the R.E. contents were fixed at 2.0% by weight, the Zr contents were fixed at 0.4% by weight, the Si contents were fixed at 0.3% by weight, and the Zn contents were varied. The magnesium alloys with I.D. Nos. 20 through 22 are the modified present heat resistant magnesium alloys whose Zn contents fell in the present composition range, the magnesium alloy with I.D. No. 23 is a comparative example which was free from Zn, and the magnesium alloy with I.D. No. 24 is a comparative example which included Zn in an amount more than the present composition range.

Furthermore, I.D. Nos. 25 through 28 are the magnesium alloys in which the Al contents were fixed at 4.0% by weight, the Zn contents were fixed at 4.0% by weight, the Zr contents were fixed at 0.4% by weight, the Si contents were fixed at 0.3% by weight, and the R.E. contents were varied. The magnesium alloys with I.D. Nos. 25 and 26 are the modified present heat resistant magnesium alloys whose R.E. contents fell in the present composition range, the magnesium alloy with I.D. No. 27 is a comparative example which was free from R.E., and the magnesium alloy with I.D. No. 28 is a comparative example which included R.E. in an amount more than the present composition range.

Moreover, I.D. No. 29 is the modified present heat resistant magnesium alloy in which the Si content was increased to about 3.3 times those of the other magnesium alloys.

Figure 15:
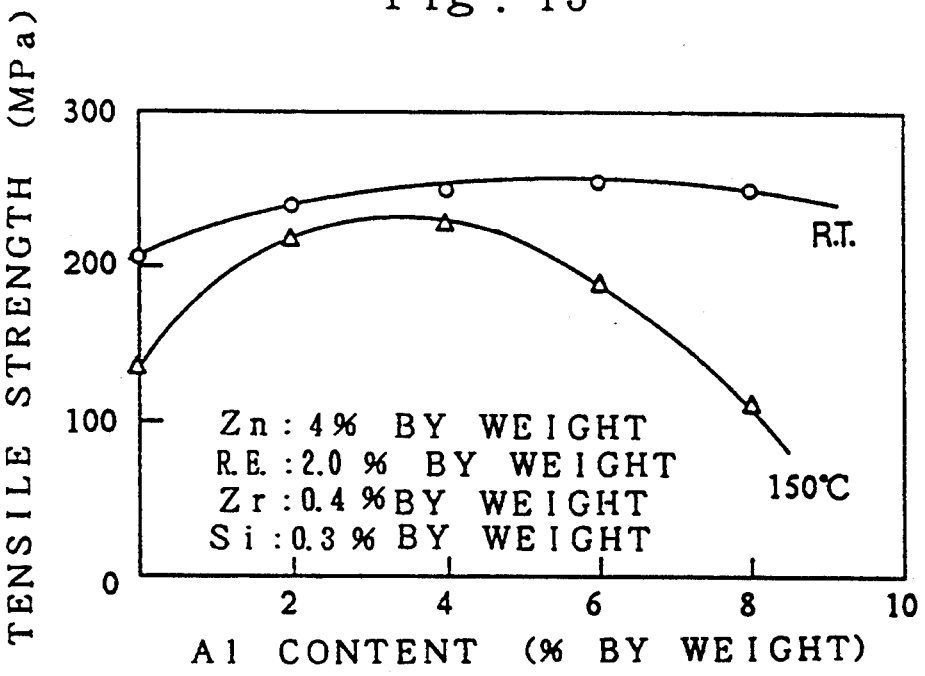
FIG. 15 is a graph illustrating the tensile strengths at room temperature as well as at 150° C. when the Al content of the modified present heat resistant magnesium alloy was varied.
Figure 16:
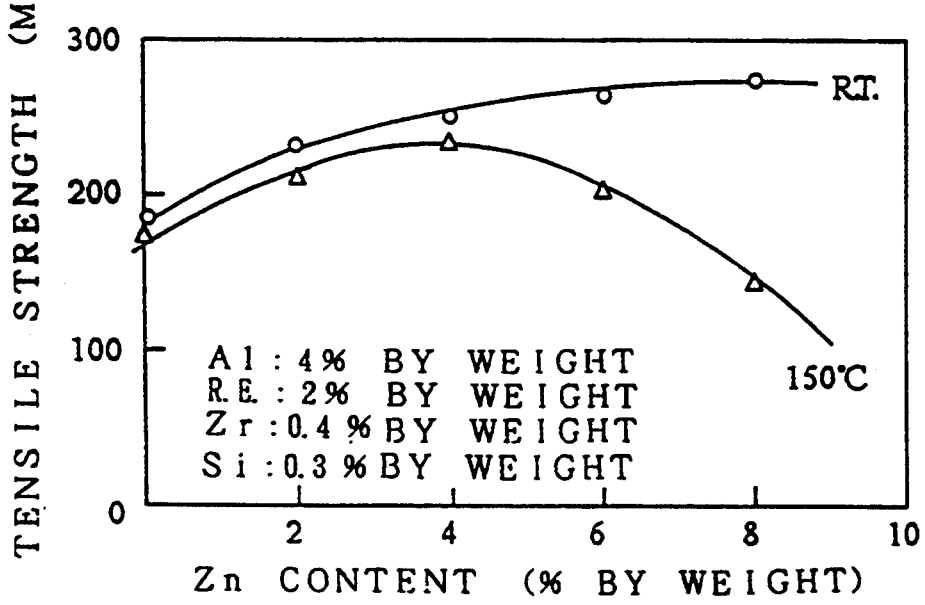
FIG. 16 is a graph illustrating the tensile strengths at room temperature as well as at 150° C. when the Zn content of the modified present heat resistant magnesium alloy was varied.
Figure 17:
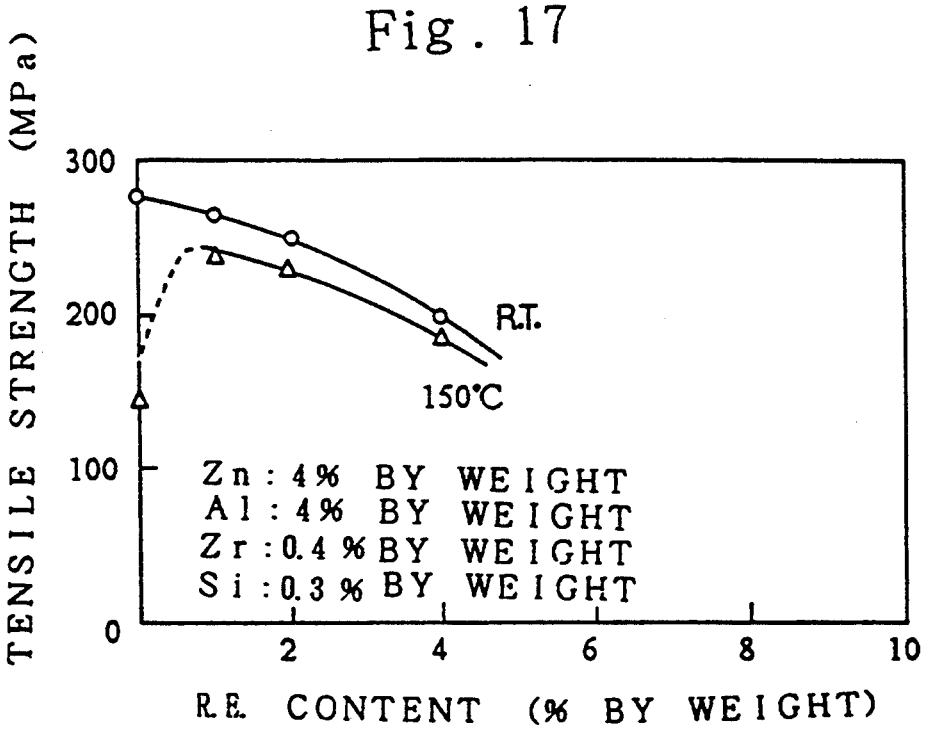
FIG. 17 is a graph illustrating the tensile strengths at room temperature as well as at 150° C. when the R.E. content of the modified present heat resistant magnesium alloy was varied.

The resulting test specimens were examined for their tensile strengths at room temperature and at 150° C. The results of this measurement are illustrated in FIGS. 15 through 17. In particular, FIG. 15 illustrates the examination results on the magnesium alloys with I.D. Nos. 15 through 19 whose Al contents were varied, FIG. 16 illustrates the examination results on the magnesium alloys with I.D. Nos. 20 through 24 whose Zn contents were varied, and FIG. 17 illustrates the examination results on the magnesium alloys with I.D. Nos. 25 through 28 whose R.E. contents were varied.

As illustrated in FIG. 15, regardless of the arrangements that the Zn contents were fixed at 4.0% by weight, the R.E. contents were fixed at 2.0% by weight, Zr was further included in the contents of 0.4% by weight and Si was further included in the contents of 0.3% by weight, and that the test specimens were prepared by gravity casting, the tensile strength properties at room temperature as well as 150° C. were identical to those illustrated in FIG. 5. Thus, it was also hold true for the modified present heat resistant magnesium alloys that they exhibited the room temperature strength of 240 MPa or more and a 150° C. tensile strength of 200 MPa or more in the aforementioned Al content range of 2.0 to 6.0% by weight.

Further, as illustrated in FIG. 16, regardless of the arrangements that the Al contents were fixed at 4.0% by weight, the R.E. contents were fixed at 2.0% by weight, Zr was further included in the contents of 0.4% by weight and Si was further included in the contents of 0.3% by weight, and that the test specimens were prepared by gravity casting, the tensile strength properties at room temperature as well as 150° C. were identical to those illustrated in FIG. 6. Thus, it was also hold true for the modified present heat resistant magnesium alloys that they exhibited the room temperature strength of 240 MPa or more and a 150° C. tensile strength of 200 MPa or more in the aforementioned Zn content range of 2.6 to 6.0% by weight.

Furthermore, as illustrated in FIG. 17, regardless of the arrangements that the Al contents were fixed at 4.0% by weight, the Zn contents were fixed at 4.0% by weight, Zr was further included in the contents of 0.4% by weight and Si was further included in the contents of 0.3% by weight, and that the test specimens were prepared by gravity casting, the tensile strength properties at room temperature as well as 150° C. were identical to those illustrated in FIG. 7. Thus, it was also hold true for the modified present heat resistant magnesium alloys that they exhibited the room temperature strength of 240 MPa or more and a 150° C. tensile strength of 200 MPa or more in the aforementioned R.E. content range of 0.2 to 2.5% by weight.

Figure 18:
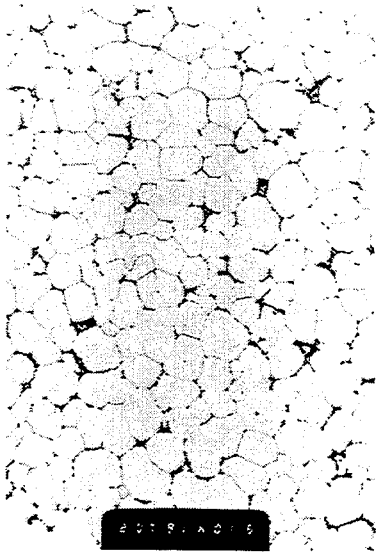
FIG. 18 is a microphotograph (magnification×100) showing the metallic structure of the modified present heat resistant magnesium alloy which was heat treated at 330° C. for 2 hours.
Figure 19:
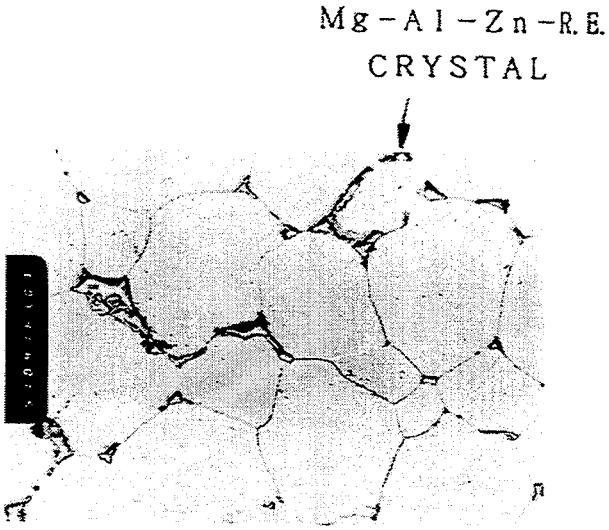
FIG. 19 is a microphotograph (magnification×250) showing the metallic structure of the modified present heat resistant magnesium alloy which was heat treated at 330° C. for 2 hours.
Figure 20:
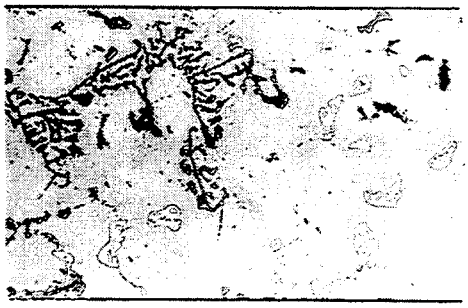
FIG. 20 is a microphotograph (magnification×250) showing the metallic structure of a test specimen which was made of the modified present heat resistant magnesium alloy, and which was subjected to the T4 treatment (i.e., a natural hardening to a stable state after a solution treatment)

FIG. 18 is a microphotograph (magnification×100) showing the metallic structure of the test specimen made of the preferred embodiment with I.D. No. 26 of the modified present heat resistant magnesium alloy. The test specimen was heat treated at 330° C. for 2 hours, and FIG. 19 is a microphotograph (magnification×250) showing the metallic structure of the same. As readily appreciated from FIGS. 18 and 19, the Mg-Al-Zn-R.E. crystals which have high melting temperatures and which are less likely to melt were crystallized in the crystal grain boundaries between the Mg-Al-Zn crystals. Additionally, FIG. 20 is a microphotograph (magnification×250) showing the metallic structure of the test specimen made of the preferred embodiment with I.D. No. 29 of the modified present heat resistant magnesium alloy. The test specimen was subjected to the T4 treatment (i.e., a natural hardening to a stable state after a solution treatment). As can be seen from FIG. 20, the micro-fine and acicular $Mg_2Si$ was confirmed to be precipitated in the metallic structure.

Fourth Preferred Embodiment

In the Fourth Preferred Embodiment, a modified present heat resistant magnesium alloy was prepared which comprised 3.0% by weight of Al, 4.0% by weight of Zn, 1.0% by weight of R.E., 0.4% by weight of Zr, 0.4% by weight of Si, and balance of Mg and inevitable impurities. This magnesium alloy was melted and processed into test specimens by gravity casting at a casting temperature of 690° C. and at mold temperatures of 80° to 120° C. The resulting test specimens were subjected to a tensile creep test which was carried out at a temperature of 423 K. under a stress of 63 MPa in order to examine the creep curves. These test specimens had a dumbbell-shaped configuration and dimensions in accordance with ASTM "80–91," paragraph 12.2.1. For comparison purposes, the conventional AZ91C and ZE41A magnesium alloys were molded into the test specimens under the identical casting conditions, and the tensile creep test was carried out under the same testing conditions in order to examine the tensile creep curves of the test specimens. The thus obtained results are illustrated in FIG. 21 altogether.

Figure 21:
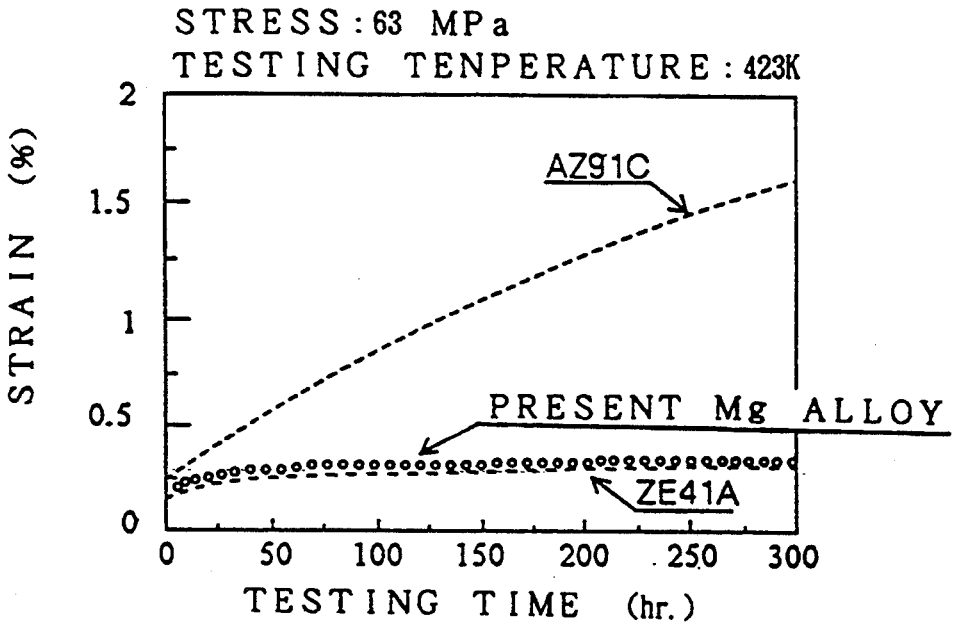
FIG. 21 illustrates the tensile creep curves which were exhibited by the modified present heat resistant magnesium alloy and the conventional AZ91C and ZE41A magnesium alloys at a testing temperature of 423 K. and under a stress of 63 MPa.

As illustrated in FIG. 21, the present magnesium alloy exhibited a creep strain which is smaller by about 1.5% than the AZ91C alloy did at 300 hours, and which was substantially equal to that of the ZE41A alloy. Consequently, it was confirmed that the present magnesium alloy was excellent not only in the ordinary temperature strength and the elevated temperature strength but also in the creep resistance.

Fifth Preferred Embodiment

In the Fifth Preferred Embodiment, a modified present heat resistant magnesium alloy was melted which comprised 4.0% by weight of Zn, 1.0% by weight of R.E., 0.4% by weight of Zr, 0.4% by weight of Si, and balance of Mg and inevitable impurities, and Al was added to the resulting molten metal in an amount of 0 to 8.0% by weight. The thus prepared magnesium alloys were cast into test specimens under the following casting conditions: a casting temperature of 690° C. and mold temperatures of 80° to 120° C., and the test specimens were subjected to a die cast hot tearings occurrence test. The test specimens were a square-shaped box test specimen having corners of predetermined radii as illustrated in FIG. 22.

The die cast hot tearings occurrence test specimen illustrated in FIG. 22 will be hereinafter described in detail. The test specimen 10 was a cylindrical body which had a square shape in a cross section, which had a thickness of 3 to 4 mm, and each of whose side had a length of 200 mm. A sprue 12 was disposed on a side 14, and a heat insulator 18 was disposed on a side 16 which was opposite to the side 14 with the sprue 12 disposed. One end of the side 16 was made into a round corner 20 having a radius of 1.0 mm, and the other end of the side 16 was made into a round corner 22 having a radius of 0.5 mm. This die cast hot tearings test specimen was intended for examining the hot tearings which were caused either in the round corner 20 or 22 by the stress resulting from the solidification shrinkage. The solidification shrinkage resulted from the solidification time difference between the portion covered with the heat insulator 18 and the other portions. In this hot tearings occurrence test, the round corner 22 having a radius of 0.5 mm was examined for the hot tearings occurrence rate, and the results of the examination are illustrated in FIG. 23.

Figure 23:
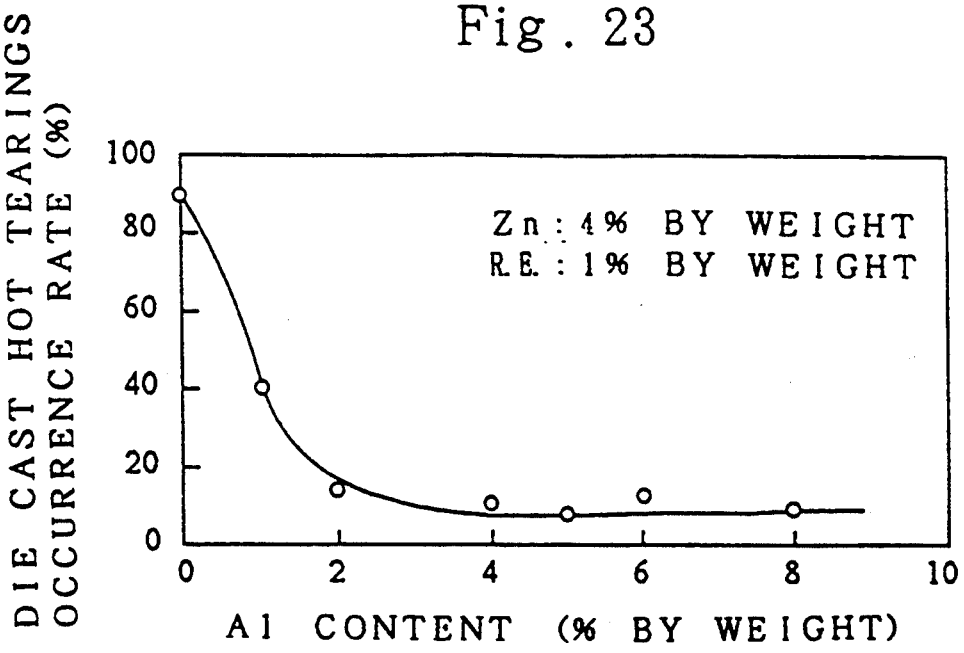
FIG. 23 is a graph illustrating the relationship between the Al content variation and the die cast hot tearings occurrence rate of the modified present heat resistant magnesium alloy.

As illustrated in FIG. 23, when Al was not included at all in the magnesium alloy, the hot tearings occurrence rate was 90%. However, the hot tearings occurrence rate decreased sharply to 40% when Al was included in an amount of 1.0% by weight in the magnesium alloy, and it further reduced to 10% when Al was included in an amount of 4.0% by weight in the magnesium alloy. As a result, the modified present heat resistant magnesium alloy was verified to be superior in the castability.

Second Evaluation

The modified present heat resistant magnesium alloy of the Fourth Preferred Embodiment was melted and processed into the test specimen illustrated in FIG. 22 by casting under the following casting conditions: a casting temperature of 690° C. and mold temperatures of 80° to 120° C., and the test specimen was subjected to the die cast hot tearings occurrence test. For comparison purposes, the conventional AZ91C and ZE41A magnesium alloys were molded into the same test specimens under the identical casting conditions, and the die cast hot tearings occurrence test was carried out. In this die cast hot tearings occurrence test, the thus prepared test specimens were examined for the hot tearings occurrence rates in the round corner 20 having a radius of 1.0 mm and the round corner 22 having a radius of 0.5 min. The results of this die east hot tearings occurrence test are illustrated in FIG. 10 altogether.

Figure 10:
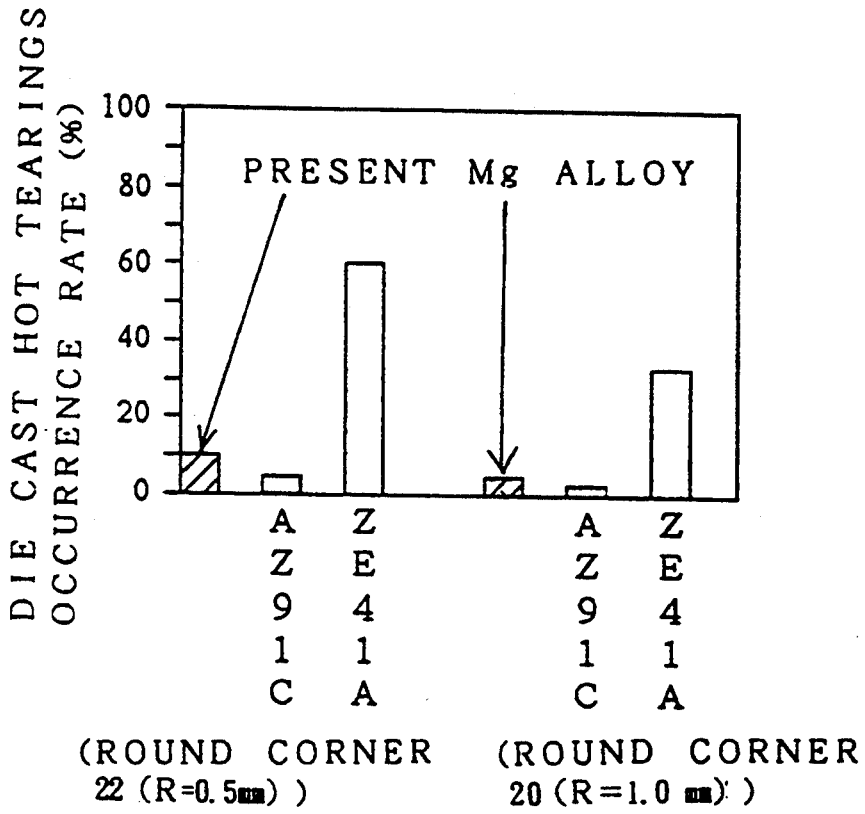
FIG. 10 is a bar graph illustrating the results of a die cast hot tearings occurrence test to which the modified version of the present heat resistant magnesium alloy and the conventional magnesium alloys were subjected.
Figure 11:
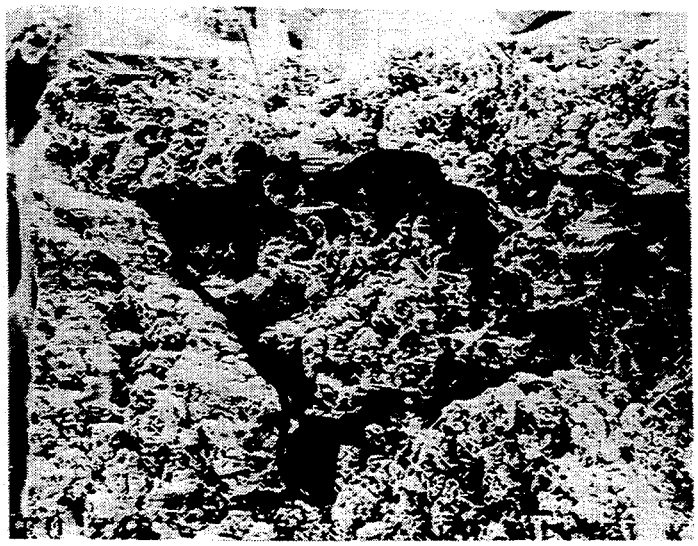
FIG. 11 PRIOR ART
FIG. 11 is a microphotograph showing an example of a metallic structure which was fractured starting at a shrinkage cavity.
Figure 12:
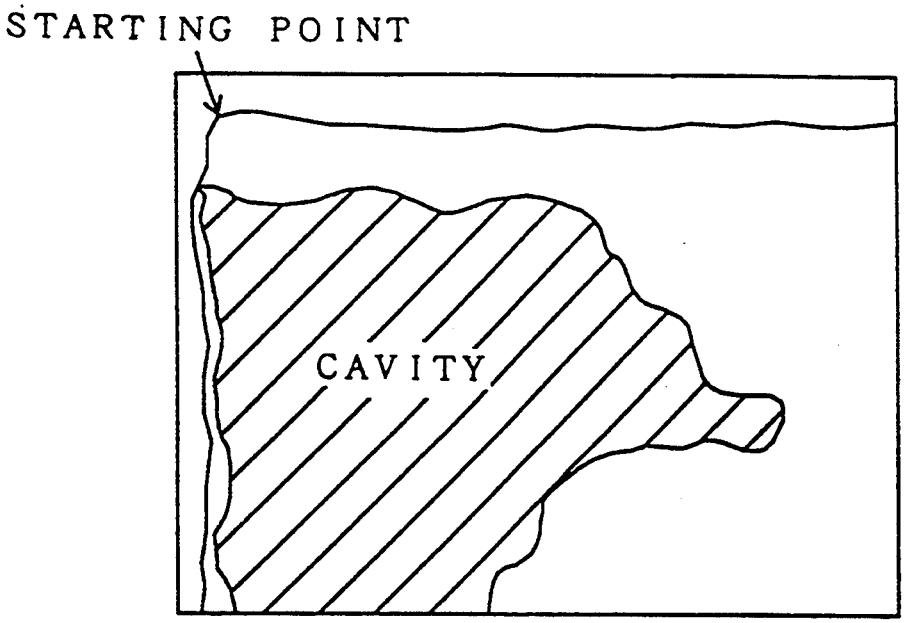
Fig. 12 ( PRIOR ART )
FIG. 12 is a schematic illustration of the microphotograph of FIG. 11 and illustrates a position of the shrinkage cavity.
Figure 13:
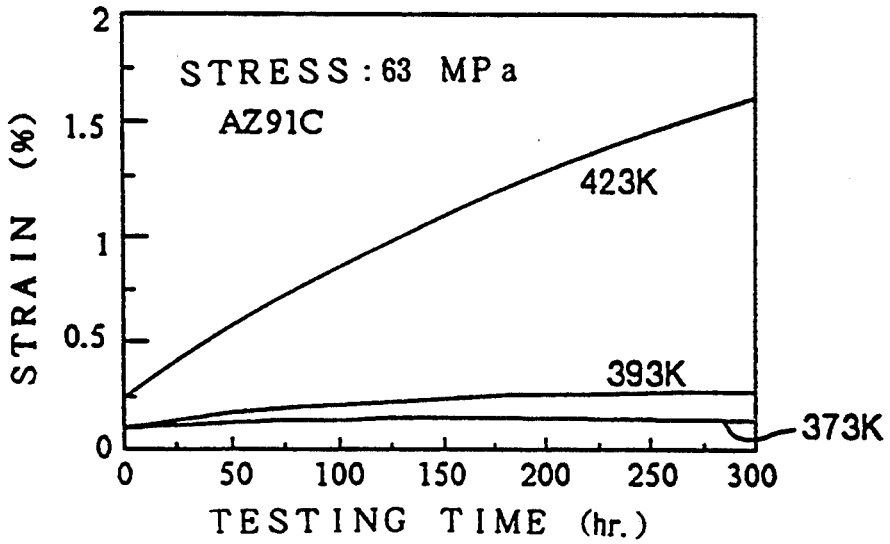
Fig. 13 ( PRIOR ART )
FIG. 13 illustrates the tensile creep curves which were exhibited by the conventional AZ91C magnesium alloy at 373 K., 393 K. and 423 K. and under a stress of 63 MPa.
Figure 14:
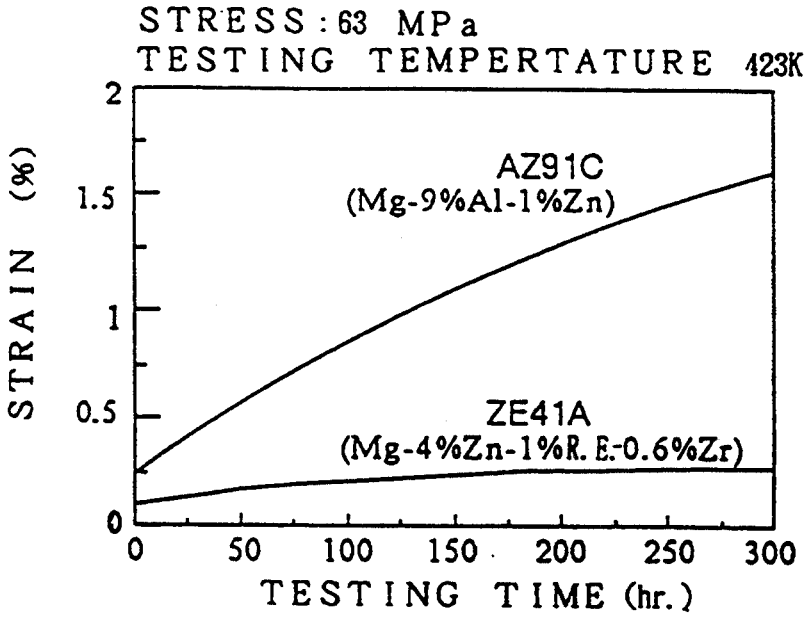
Fig. 14 (PRIOR ART)
FIG. 14 illustrates the tensile creep curves which were exhibited by the conventional AZ91C and ZE41A magnesium alloys at a testing temperature of 423 K. and under a stress of 63 MPa.

As can be understood from FIG. 10, the conventional ZE41A magnesium alloy exhibited a hot tearings occurrence rate of 60% in the round corner 22 having a radius of 0.5 mm, and the conventional AZ91C magnesium alloy exhibited a hot tearings occurrence rate of 5% therein, but the modified present heat resistant magnesium alloy exhibited a hot tearings occurrence rate of 10% therein. Regarding the hot tearings occurrence rates in the round corner 20 having a radius of 1.0 mm, the ZE41A magnesium alloy exhibited a hot tearings occurrence rate of 32% therein, and the conventional AZ91C magnesium alloy exhibited a hot tearings occurrence rate of 3% therein, but the modified present heat resistant magnesium alloy exhibited a hot tearings occurrence rate of 7% therein. Thus, the modified present heat resistant magnesium alloy was confirmed to have a castability substantially similar to that of the AZ91AC magnesium alloy.

Third Evaluation

The modified present heat resistant magnesium alloy of the Fourth Preferred Embodiment was melted and processed into a square-shaped plate test specimen by gravity casting under the following casting conditions: a casting temperature of 690° C. and mold temperatures of 80° to 120° C. Also, the conventional AZ91AC magnesium alloy which comprised 9.0% by weight of Al, 1.0% by weight of Zn, and balance of Mg and inevitable impurities, and a conventional Al alloy which comprised 6.0% by weight of Si, 3.0% by weight of Cu, 0.3% by weight of Mg, 0.3% by weight of Mn, and balance of Al and inevitable impurities were processed similarly into the square-shaped plate test specimen. The resulting test specimens were subjected to a corrosion test in which they were immersed into a salt aqueous solution containing $H_2SO_4$ at 85° C. for 192 hours, and their weight increments resulting from the oxide deposition were measured in order to examine their corrosion resistance. Namely, their corrosion resistances were evaluated by their corrosion weight variation ratios which were calculated by taking their original weights as 1.0. The thus obtained results are illustrated in FIG. 24.

Figure 24:
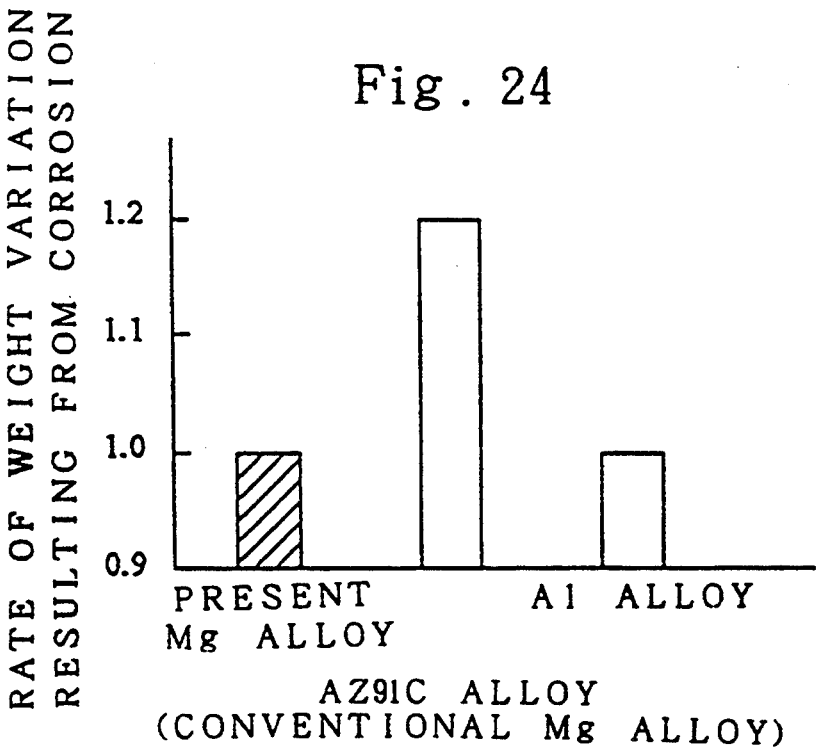
FIG. 24 is a bar graph illustrating the weight variation rates of the modified present heat resistant magnesium alloy, the conventional AZ91C alloy and a conventional Al alloy after a corrosion test.

As illustrated in FIG. 24, the AZ91C magnesium alloy, one of the conventional magnesium alloys, exhibited a corrosion weight variation ratio of 1.2. On the contrary, the modified present heat resistant magnesium alloy hardly showed a weight variation resulting from the corrosion, and it exhibited a corrosion weight variation ratio of 1.0. Thus, it was verified that the modified present heat resistant magnesium alloy exhibited a corrosion resistance equivalent to that of the conventional Al alloy which also exhibited a corrosion weight variation ratio of 1.0.

Figure 25:
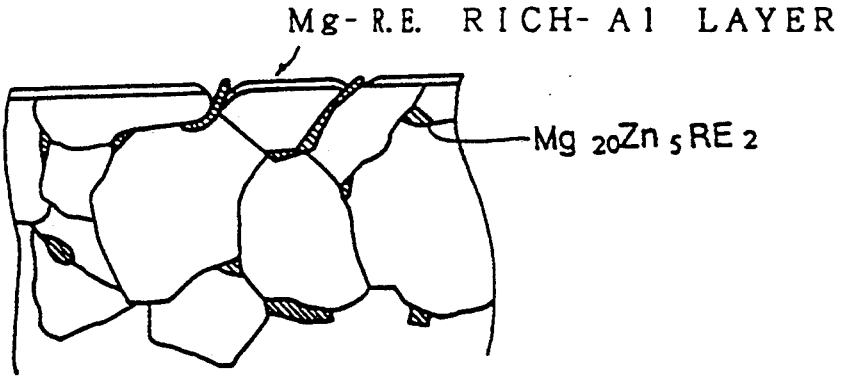
FIG. 25 is a cross sectional schematic illustration of the metallic structure of the modified present heat resistant magnesium alloy in the corroded surface after the corrosion test.
Figure 26:
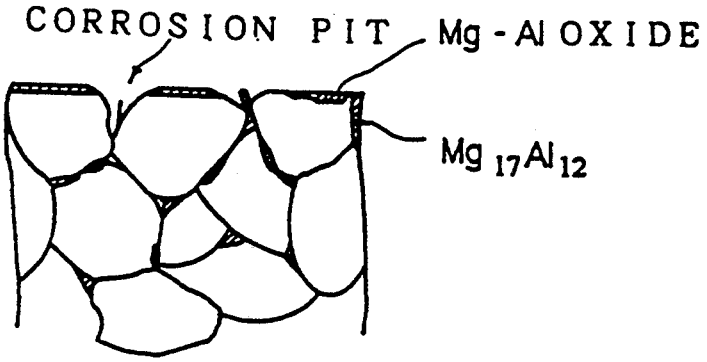
Fig. 26 ( PRIOR ART )
FIG. 26 is a cross sectional schematic illustration of the metallic structure of the conventional AZ91C magnesium alloy in the corroded surface after the corrosion test.

Further, FIG. 25 is a cross sectional schematic illustration of the metallic structure of the modified present heat resistant magnesium alloy in the corroded surface, and FIG. 26 is a cross sectional schematic illustration of the metallic structure of the conventional AZ91C magnesium alloy in the corroded surface. In the test specimen made of the modified present heat resistant magnesium alloy and illustrated in FIG. 25, there were formed Mg-R.E.-Al oxide layers on the corroded surface, and R.E. got concentrated in the Mg-R.E.-Al oxide layers. This is why the corrosion pits were inhibited from developing into the inside. On the other hand, in the test specimen made of the conventional AZ91C magnesium alloy and illustrated in FIG. 26, there were generated Mg-Al oxide layers, and at the same time Al become insufficient adjacent to $Mg_{17}Al_{12}$ crystals forming the grain boundaries, which resulted in the starting points of the corrosion pits generation.

Figure 27:
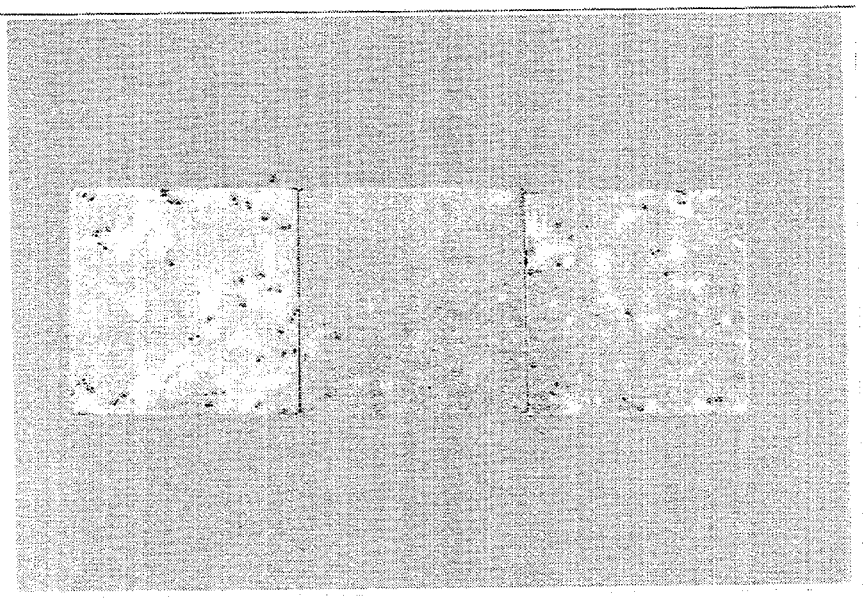
FIG. 27 is a photograph showing test specimens made of the conventional AZ91C magnesium alloy after the corrosion test.
Figure 28:
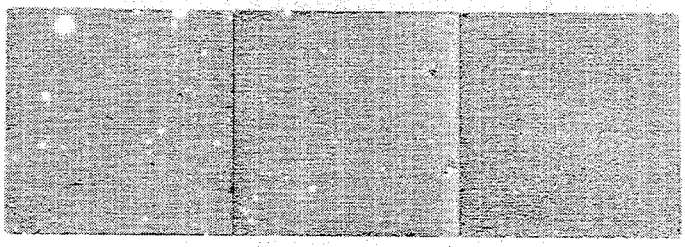
( PRIOR ART ) Fig. 28
FIG. 28 is a photograph showing test specimens which were made of the modified present heat resistant magnesium alloy after the corrosion test.
Figure 29:
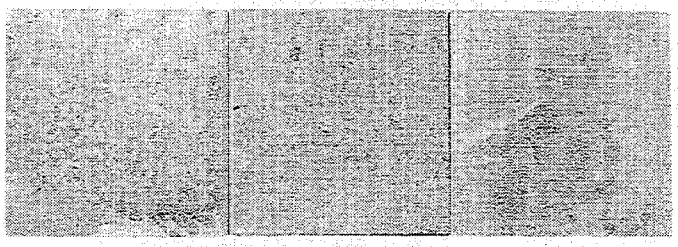
FIG. 29 is a photograph showing test specimens which were made of the conventional Al alloy after the corrosion test.
Figure 30:
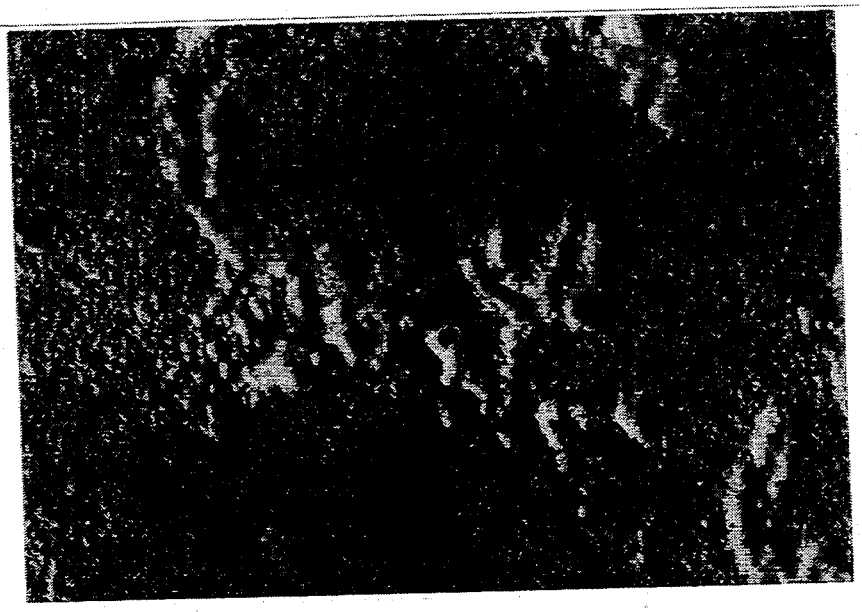
( PRIOR ART ) Fig. 30
FIG. 30 is an enlarged photograph of FIG. 27 and shows the corroded pits which occurred in the test specimens which were made of the conventional AZ91C magnesium alloy after the corrosion test.
Figure 31:
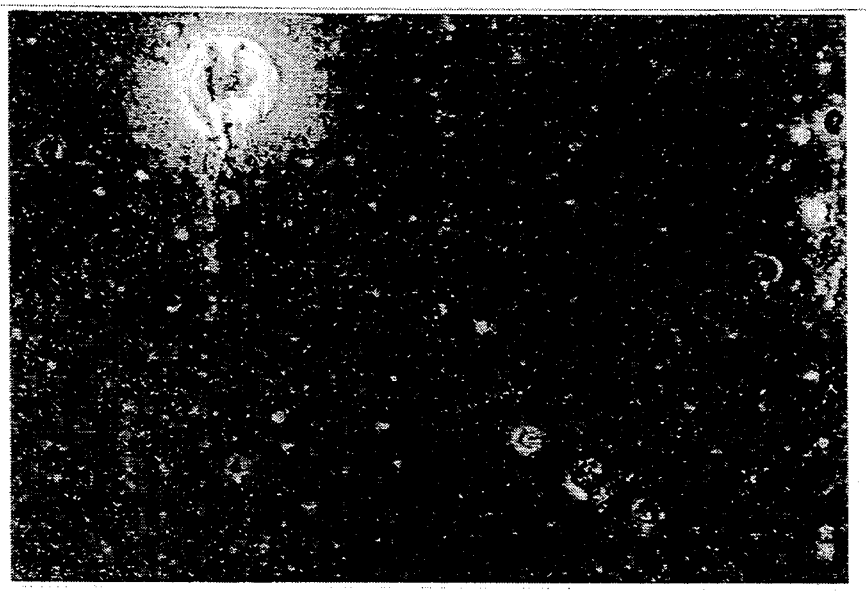
FIG. 31 is an enlarged photograph of FIG. 28 and shows the corroded pits which occurred in the test specimens which were made of the modified present heat resistant magnesium alloy after the corrosion test.
Figure 32:
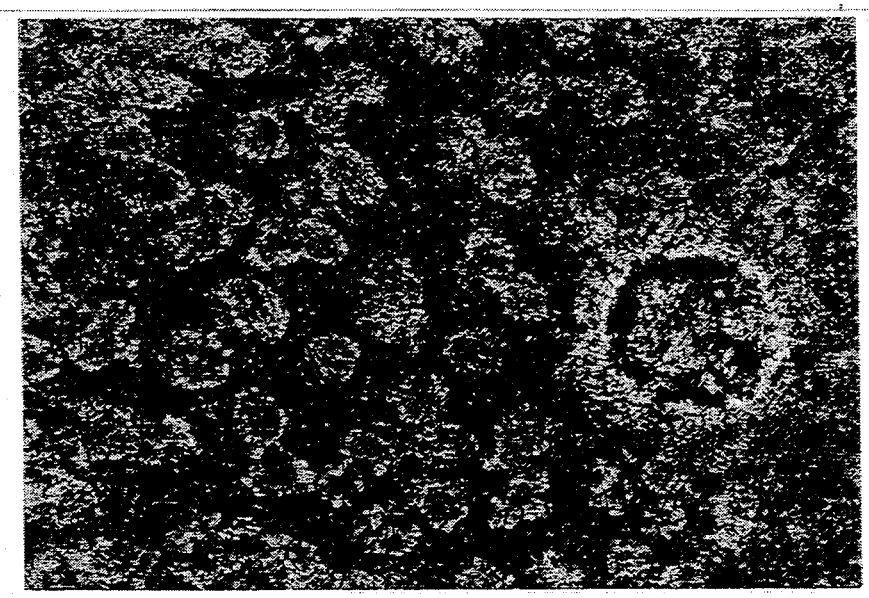
FIG. 32 is an enlarged photograph of FIG. 29 and shows the corroded pits which occurred in the test specimens which were made of the conventional Al magnesium alloy after the corrosion test.

Furthermore, as can be seen from FIGS. 27 and 30 which are photographs showing the test specimens made of the conventional AZ91C magnesium alloy after the corrosion test, the surfaces of the test specimens were covered with white rusts all over and observed to have many corrosion pits. It is also noted from FIG. 30, which is an enlarged version of FIG. 27 for examining one of the corrosion pits, that the corrosion pit reached deep inside. On the other hand, as can be seen from FIGS. 28 and 31 which are photographs showing test specimens made of the modified present heat resistant magnesium alloy, the white rusts scattered on the surface of the test specimens, and the corrosion pits were generated in an extremely lesser quantity. Thus, the corrosion resistance of the modified present heat resistant magnesium alloy was found out to be as good as that of the conventional Al alloy whose corroded surfaces are shown in FIGS. 29 and 32. Similarly, FIG. 31 is an enlarged version of FIG. 29 for examining one of the corrosions pits, and it can be noted from FIG. 31 that the corrosion pit was a very shallow one.

Having now fully described the present invention, it will be apparent to one of ordinary skill in the art that many changes and modifications can be made thereto without departing from the spirit or scope of the present invention as set forth herein including the appended claims.

What is claimed is:

1. A heat resistant magnesium alloy, consisting essentially of:

0.1 to 6.0% by weight of aluminum (Al):
1.0 to 6.0% by weight of zinc (Zn);
0.1 to 2.0% by weight of rare earth element;
0.1 to 2.0% by weight of zirconium (Zr);
0.1 to 3.0% by weight of silicon (Si); and
balance of magnesium (Mg) and inevitable impurities.

2. The heat resistant magnesium alloy of claim 1, wherein said zirconium is present in the amount of 0.5 to 1.0% by weight.

3. The heat resistant magnesium alloy of claim 1, wherein said silicon is present in the amount of 0.5 to 1.5% by weight.

4. A mold-cast structure formed of the heat resistant magnesium alloy of claim 1.

* * * * *